US009290021B2

(12) United States Patent
Samoto et al.

(10) Patent No.: US 9,290,021 B2
(45) Date of Patent: Mar. 22, 2016

(54) INKJET RECORDING APPARATUS

(71) Applicants: Kenji Samoto, Nagoya (JP); Yuji Koga, Nagoya (JP); Noriyuki Kawamata, Nagoya (JP); Wataru Sugiyama, Nishio (JP); Tsuyoshi Ito, Nagoya (JP)

(72) Inventors: Kenji Samoto, Nagoya (JP); Yuji Koga, Nagoya (JP); Noriyuki Kawamata, Nagoya (JP); Wataru Sugiyama, Nishio (JP); Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/628,749

(22) Filed: Sep. 27, 2012

(65) Prior Publication Data

US 2013/0135388 A1 May 30, 2013

(30) Foreign Application Priority Data

Nov. 28, 2011 (JP) ..... 2011-259490
Apr. 27, 2012 (JP) ..... 2012-102177

(51) Int. Cl.
*B41J 2/165* (2006.01)
*B41J 11/06* (2006.01)
*B41J 11/00* (2006.01)

(52) U.S. Cl.
CPC ..... *B41J 11/06* (2013.01); *B41J 11/005* (2013.01)

(58) Field of Classification Search
None
See application file for complete search history.

(56) References Cited

U.S. PATENT DOCUMENTS

| | | | | |
|---|---|---|---|---|
| 5,564,847 | A * | 10/1996 | Patrick et al. | 400/642 |
| 5,897,259 | A * | 4/1999 | Ahn | 400/629 |
| 2003/0007023 | A1 * | 1/2003 | Barclay et al. | 347/8 |
| 2010/0207321 | A1 | 8/2010 | Samoto et al. | |
| 2013/0135388 | A1 | 5/2013 | Samoto et al. | |

FOREIGN PATENT DOCUMENTS

| | | | |
|---|---|---|---|
| CN | 101804921 | A | 8/2010 |
| CN | 203063276 | U | 7/2013 |
| JP | 4069264 | A | 3/1992 |
| JP | 11138923 | A | 5/1999 |
| JP | 2000071532 | | 3/2000 |

OTHER PUBLICATIONS

Jul. 3, 2014—(CN) First Office Action—App 201210496701.X.

* cited by examiner

*Primary Examiner* — Alejandro Valencia
(74) *Attorney, Agent, or Firm* — Banner & Witcoff, Ltd.

(57) ABSTRACT

An image forming device may include a contact member and a support member configured to support a recording portion. In one or more arrangements, the contact member may be disposed on the support member and include a contact portion configured to contact a sheet being conveyed. In some examples, the support member may include a carriage frame. Additionally or alternatively, the image forming device may include a platen having a plurality of ribs. In one or more examples, the ribs may be configured to form a corrugated shape in a sheet in conjunction with the contact member. Still further, one or more of the ribs and the contact member may be movable.

25 Claims, 14 Drawing Sheets

INKJET RECORDING APPARATUS

CROSS-REFERENCE TO RELATED APPLICATIONS

This application claims priority from Japanese Patent Application No. 2012-102177, filed on Apr. 27, 2012, which claims priority from Japanese Patent Application No. 2011-259490, filed on Nov. 28, 2011. The disclosures of these applications are incorporated herein by reference in their entirety.

TECHNICAL FIELD

Aspects described herein relate to contact members in an image forming device. In some examples, the contact members may be configured to reduce lifting or curling of a sheet on a platen.

BACKGROUND

A known inkjet recording apparatus includes a platen configured to hold a sheet being conveyed along a conveying direction, and a recording portion configured to reciprocate along a main-scanning direction orthogonal to the conveying direction. The known inkjet recording apparatus is configured to record an image onto the sheet held by the platen by ejecting ink droplets from the recording portion. The known inkjet recording apparatus further includes contact members configured to reduce lifting or curling of the sheet on the platen. The contact members are disposed in a gap between the platen and the recording portion and configured to come into contact with an upper surface of the sheet being conveyed. This configuration reduces the lifting or curling of the sheet on the platen.

SUMMARY

As the gap between the recording portion and the platen is reduced or narrowed, an ink-droplet ejecting distance may become smaller and an image-recording accuracy may be improved. However, when the gap is narrowed, the contact members may be located in close vicinity to the recording portion. The recording portion is supported by a support member that allows the recording portion to reciprocate. When the platen is disposed below the recording portion, the recording portion being reciprocated and the contact members may make contact with each other if the support member is warped or deformed toward the platen. When the recording portion and the contact members make contact with each other, ink may move (e.g., transfer) to the contact members from the recording portion or the reciprocating movement of the recording portion may be impaired.

According to one or more aspects, a configuration may be used to reduce a risk of contact between a recording portion and contact members due to deformation or displacement of a support member.

In one or more examples, an inkjet recording apparatus may comprise a conveyor configured to convey a sheet along a conveying direction. A recording portion may be configured to eject ink droplets from nozzles onto the sheet. A support member may be configured to support the recording portion to be movable along a scanning direction. A contact member may be disposed on the support member and comprising a contact portion configured to contact the sheet between the nozzles and the conveyor with respect to the conveying direction.

In some example, an inkjet recording apparatus may comprise a conveyor configured to convey a sheet along a conveying direction. A platen may be disposed downstream of the conveyor with respect to the conveying direction and comprising a plurality of ribs. A carriage may be disposed opposite to the platen and comprising a recording head configured to eject ink droplets from nozzles. A carriage frame may be configured to movably support the carriage. A contact member may comprise a contact portion configured to contact the sheet at a position between the conveyor and the nozzles with respect to the conveying direction, and wherein the contact portion is disposed between a pair of ribs of the plurality of ribs with respect to a moving direction of the carriage. wherein, when the platen is not supporting the sheet, a protruding edge of the support rib is located closer to the carriage than an edge of the contact portion in a pressing direction in which the contact portion is configured to contact the sheet.

In other example, an inkjet recording apparatus recording apparatus may comprise a carriage configured to support a recording head configured to eject ink droplets from nozzles onto a sheet. A carriage frame, wherein the carriage is movably supported by the carriage frame such that the carriage is located downstream of the carriage frame with respect to a sheet conveying direction. A contact member may be attached to the carriage frame and comprising a contact portion configured to contact the sheet at a position downstream of at least a portion of the carriage frame with respect to the sheet conveying direction.

According to some aspects, the contact portion of the contact member may contact an upper surface of the sheet being conveyed over the platen to reduce lifting or curling of the sheet on the platen. When the support member is warped or deformed downward, the recording portion may be moved downward correspondingly. Then, the contact members disposed on the support member may also be moved downward by an amount corresponding to an amount that the recording portion was moved. In one example, the amount by which the contact members are moved downward may equal the amount that the recording portion was moved. This configuration may reduce a risk of contacting the recording portion and the contact members with reach other.

According to other aspects, the contact members may be disposed on the support member. With this configuration, the contact between the recording portion and the contact members caused by deformation or displacement of the support member may be reduced. Accordingly, an image-recording accuracy may be improved while a gap between the recording portion and the platen is narrowed.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION OF EMBODIMENT

Figure 1:
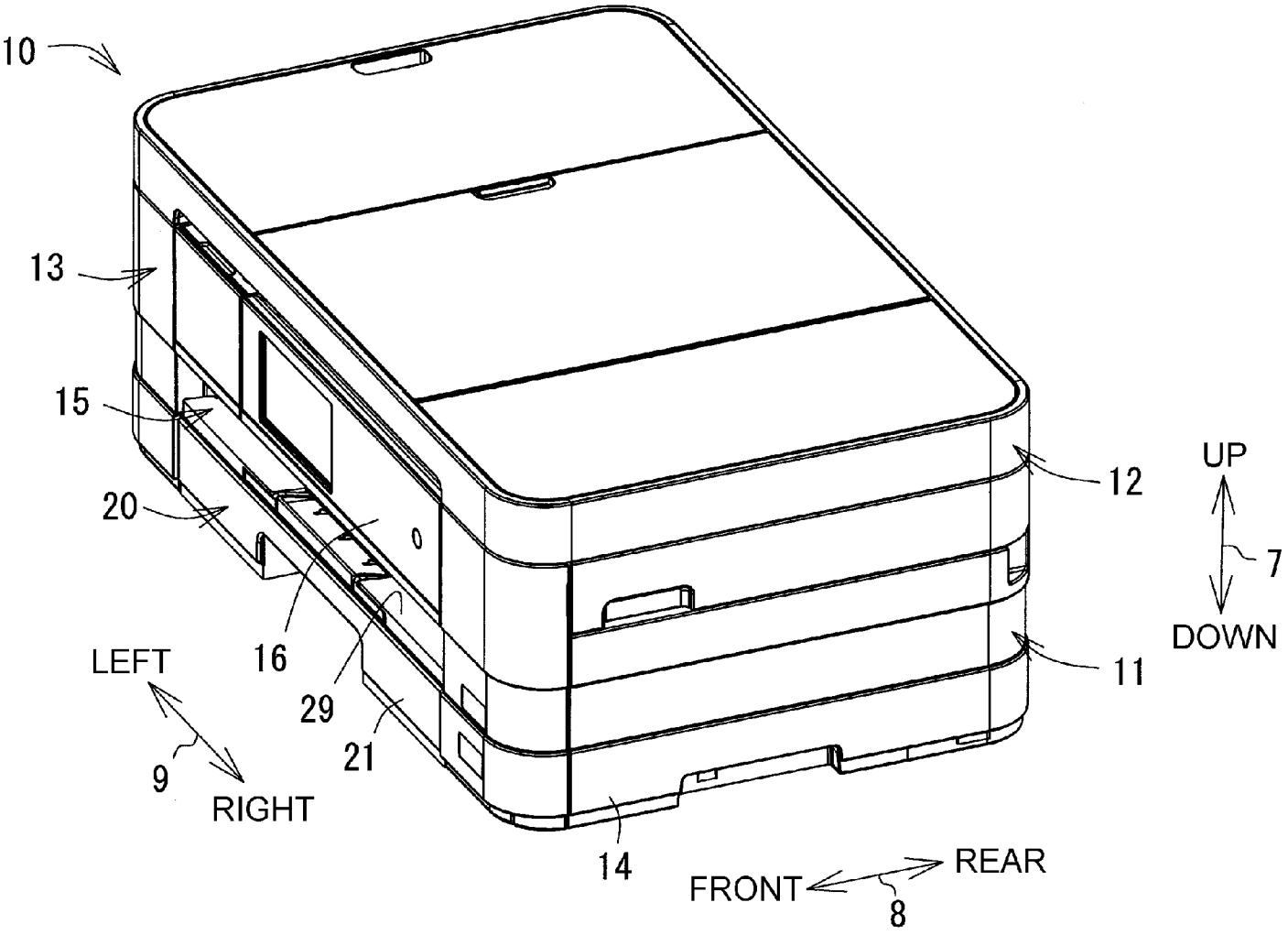
FIG. 1 is a perspective view depicting an inkjet recording apparatus in an illustrative embodiment according to one or more aspects of the disclosure.

An illustrative embodiment according to one or more aspects of the disclosure is described below with reference to the accompanying drawings. The illustrative embodiment described below is only an example of the one or more aspects of the disclosure. It would be apparent to those skilled in the art that various changes, arrangements and modifications may be applied therein without departing from the spirit and scope of the disclosure. As depicted in FIG. 1, an up-down direction 7 may be defined with reference to an orientation of an inkjet recording apparatus 10 that may be disposed in which it may be intended to be used. A side of the inkjet recording apparatus 10, in which a control panel 16 may be provided, may be defined as the front of the inkjet recording apparatus 10. A front-rear direction 8 may be defined with reference to the front of the inkjet recording apparatus 10. A right-left direction 9 may be defined with respect to the inkjet recording apparatus 10 as viewed from its front.

As depicted in FIG. 1, the inkjet recording apparatus 10 may comprise a printer unit 11 and a scanner unit 12. The printer unit 11 may be configured to record an image onto a sheet 6 (see FIG. 2). The sheet 6 may be, for example, recording paper, glossy paper, or a postcard. The scanner unit 12 may be configured to read an image recorded on a document (not depicted). The inkjet recording apparatus 10 may be configured to perform one or more of printing, scanning, and copying. The inkjet recording apparatus 10 may not necessarily comprise the scanner unit 12, whose detailed description is omitted.

As depicted in FIG. 1, the printer unit 11 may comprise a main body 13 and a sheet feed cassette 20. The sheet feed cassette 20 may be disposed in a lower portion of the main body 13. The sheet feed cassette 20 may be configured to accommodate one or more sheets 6 (see FIG. 2) that may be loaded therein. The main body 13 may comprise a housing 14 (see FIG. 1) that may comprise therein a feeding portion 40, a conveying path 31, a conveyor roller pair 34, a discharge roller pair 37, contact members 60, 70, and a recording portion 45. The main body 13 may be configured to feed the sheet 6 into the conveying path 31 by the feeding portion 40 and convey the fed sheet 6 by the conveyor roller pair 34. The contact members 60, 70 may be configured to press the sheet 6 being conveyed. The main body 13 may be further configured to record an image onto the sheet 6 pressed by the contact members 60, 70 by ejecting ink droplets from the recording portion 45. The main body 13 may be further configured discharge the sheet 6 onto a sheet discharge tray 29 of the sheet feed cassette 20 by the discharge roller pair 37. Hereinafter, various components of the printer unit 11 are described.

As depicted in FIG. 1, the housing 14 may have an opening 15 in the front of the housing 14 with respect to the front-rear direction 8. The sheet feed cassette 20 may be inserted into or removed from the inkjet recording apparatus 10 via the opening 15.

Figure 2:
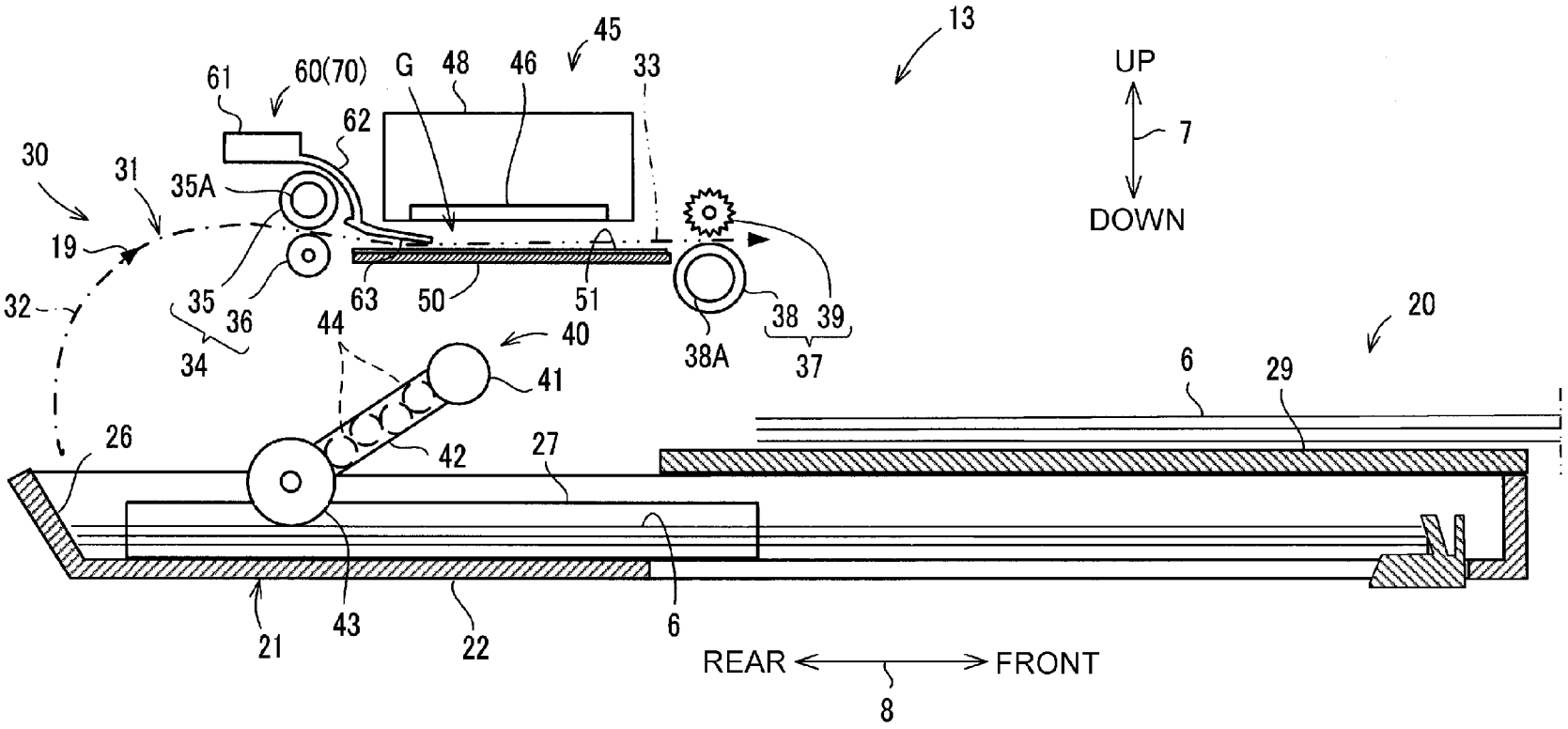
FIG. 2 is a schematic longitudinal sectional view depicting a main body of the inkjet recording apparatus in the illustrative embodiment according to one or more aspects of the disclosure.

As depicted in FIG. 1, the sheet feed cassette 20 may be configured to be accommodated in the lower portion of the housing 14 and be slidable along the front-rear direction 8. As depicted in FIG. 2, the sheet feed cassette 20 may comprise a main tray 21 and the sheet discharge tray 29. The main tray 21 may be configured to hold one or more sheets 6 on which an image is to be recorded. The sheet discharge tray 29 may be configured to receive one or more sheets 6 on which an image has been recorded. The sheet discharge tray 29 may be disposed above the main tray 21 and supported by the main tray 21.

As depicted in FIG. 2, the main tray 21 may comprise a lower surface 22 and an inclined wall 26. One or more sheets 6 may be received on the lower surface 22 of the main tray 21. The inclined wall 26 may extend obliquely upward from a rear end of the lower surface 22 with respect to the front-rear direction 8. The inclined wall 26 may be configured to allow the one or more sheets 6 to move obliquely upward into the conveying path 31 from the feeding portion 40. A side guide mechanism 27 may be disposed on the lower surface 22. The side guide mechanism 27 may be configured to center the one or more sheets 6 received on the lower surface 22 (center alignment) to reduce skewing of the sheet 6 to be fed by the feeding portion 40. In the center alignment, one or more sheets 6 of any size may be positioned on the lower surface 22 while the center line of the one or more sheets 6 with respect to the right-left direction 9 may be aligned with the center line of the main tray 21 with respect to the right-left direction 9.

Figure 4:
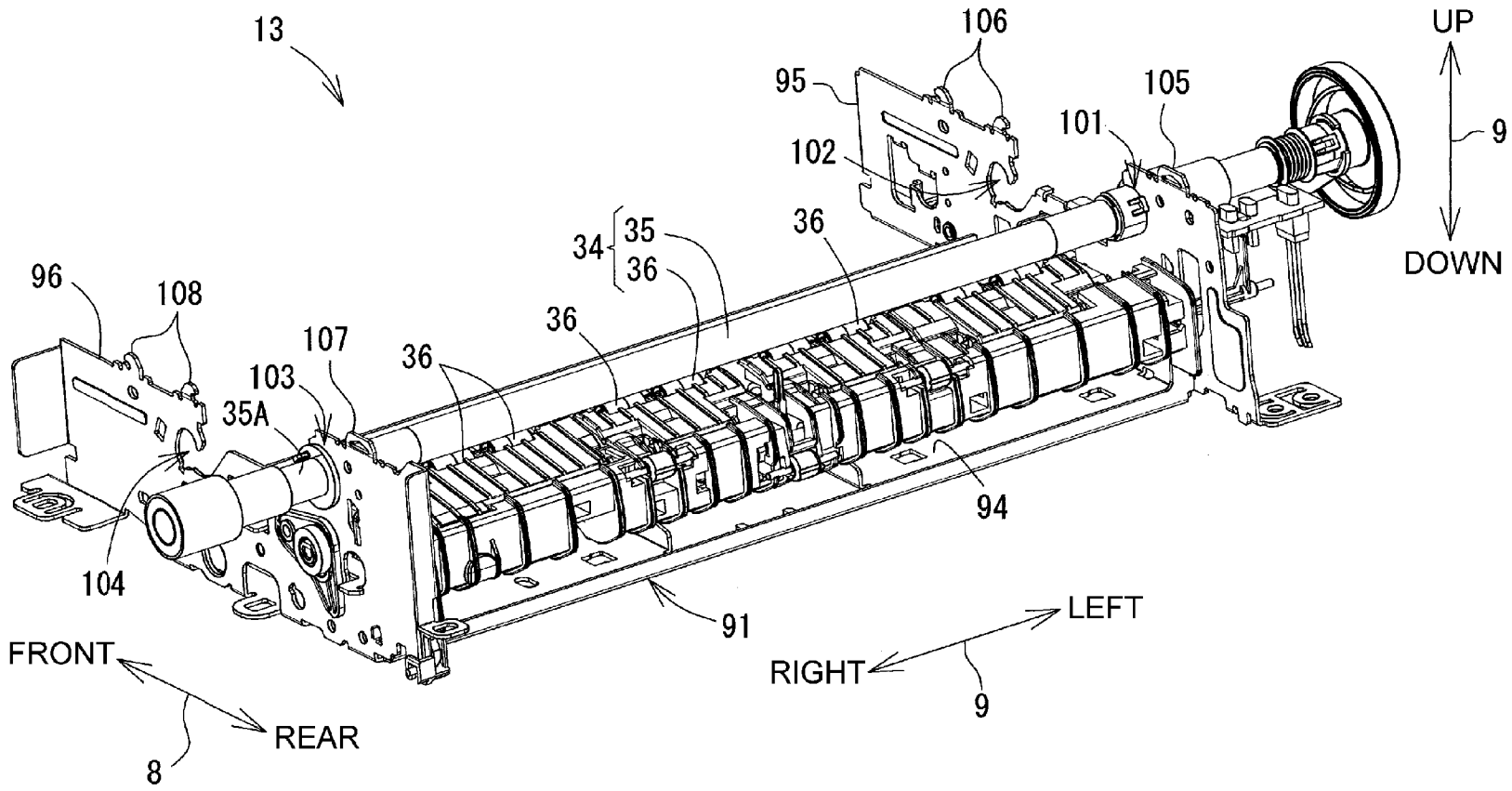
FIG. 4 is a partial back perspective view depicting the main body in the illustrative embodiment according to one or more aspects of the disclosure.

A frame 91 (see FIG. 4) may be disposed above the sheet feed cassette 20. The frame 91 may be configured to support, for example, a conveyor roller 35, discharge rollers 38 (see FIG. 2), and a platen 50 (see FIG. 2). The frame 91 may be formed such that both end portions of a steel plate may be bent upward with respect to the right-left direction 9. The frame 91 may comprise a lower wall 94, a left side-wall 95, and a right side-wall 96. The left side-wall 95 and the right side-wall 96 may be opposite to each other with respect to the right-left direction 9. The frame 91 may be disposed above the sheet feed cassette 20 and fixed to the housing 14 by screws, for example. In FIG. 2, the frame 91 is omitted from the drawing.

The left side-wall 95 and the right side-wall 96 may have circular cutaway portions 101, 103, respectively. The cutaway portions 101, 103 may be configured to rotatably support therein a rotating shaft 35A of the conveyor roller 35. The left side-wall 95 and the right side-wall 96 may further have circular cutaway portions 102, 104, respectively. The cutaway portions 102, 104 may be configured to rotatably support therein a rotating shaft 38A (see FIG. 2) of the discharge rollers 38.

Figure 5:
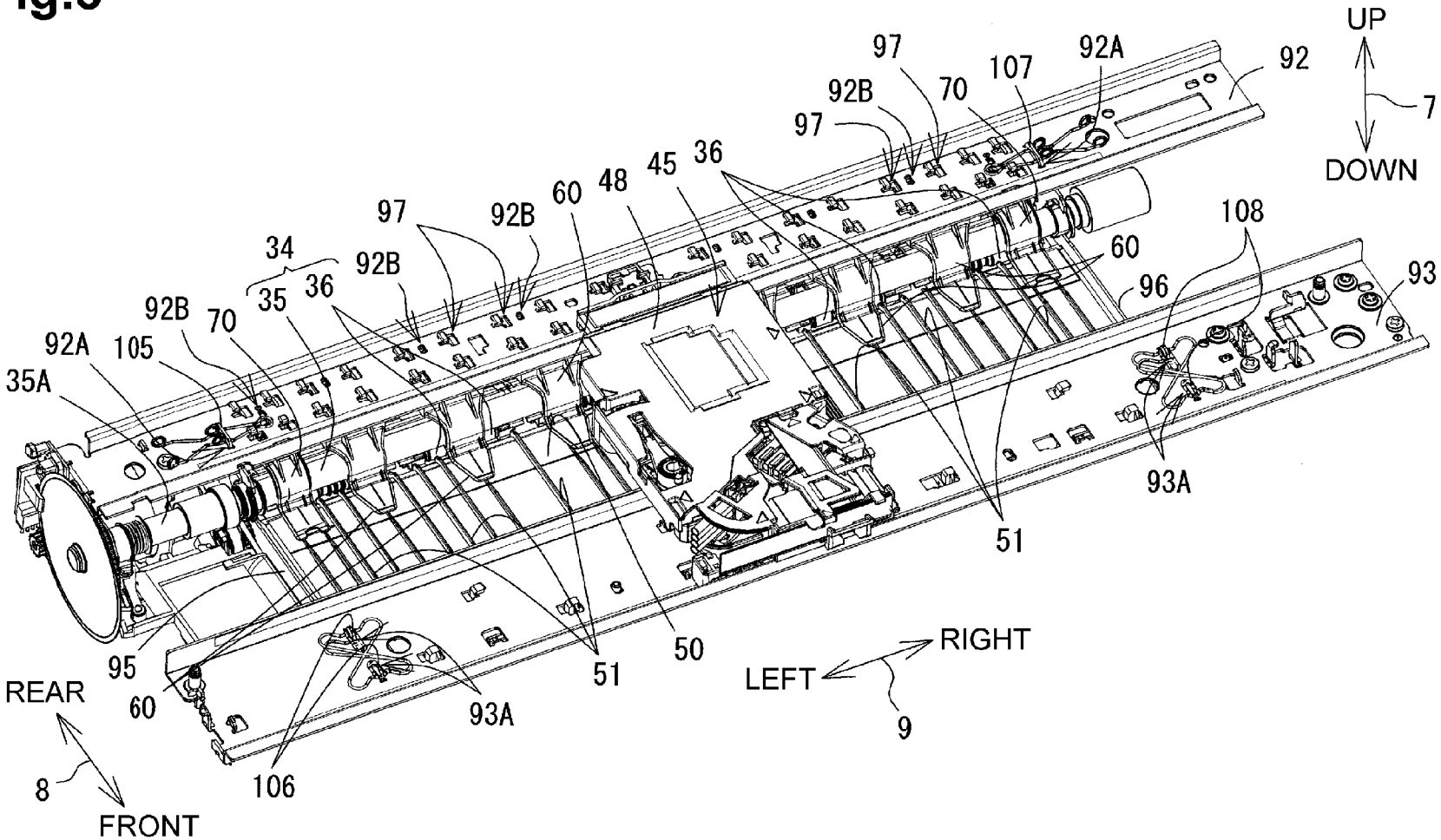
FIG. 5 is a partial front perspective view depicting the main body in the illustrative embodiment according to one or more aspects of the disclosure.

The left side-wall 95 and the right side-wall 96 may further comprise engagement portions 105, 107 that may be configured to be engaged with a guide rail 92 (see FIG. 5). The engagement portion 105 may protrude upward from a rearward part of an upper edge of the left side-wall 95 with respect to the front-rear direction 8. The engagement portion 107 may protrude upward from a rearward part of an upper edge of the right side-wall 96 with respect to the front-rear direction 8. The left side-wall 95 and the right side-wall 96 may further comprise engagement portions 106, 108 that may be configured to be engaged with a guide rail 93 (see FIG. 5). The engagement portions 106 may protrude upward from a forward part of the upper edge of the left side-wall 95 with respect to the front-rear direction 8. The engagement portions 108 may protrude upward from a forward part of the upper edge of the right side-wall 96 with respect to the front-rear direction 8.

As depicted in FIG. 5, the guide rails 92, 93 may be configured to support the recording portion 45 such that the recording portion 45 may be allowed to reciprocate along the right-left direction 9. The guide rails 92, 93 may have a plate-like shape and extend along the right-left direction 9. The guide rails 92, 93 may be made of steel sheets that may extend along the right-left direction 9 with upwardly bent forward and rearward edge portions with respect to the front-rear direction 8.

The guide rail 92 may have an insertion slit 92A in each end portion of the guide rail 92 with respect to the right-left direction 9. The engagement portions 105, 107 (see FIG. 4) of the frame 91 may be inserted into the respective insertion slits 92A. The guide rail 93 may include insertion slits 93A in each end portion of the guide rail 93 with respect to the right-left direction 9. The engagement portions 106, 108 (see FIG. 4) of the frame 91 may be inserted into respective insertion slits 93A. The guide rails 92, 93 may bridge between the upper edge of left side-wall 95 and the upper edge of the right side-wall 96 and fixed to the frame 91 by the engagement portions 105-108.

A carriage 48 may be disposed between the forward edge portion of the bent portion of the guide rail 92 and the rearward edge portion of the bent portion of the guide rail 93. The guide rails 92, 93 may support the carriage 48 to allow the carriage 48 to reciprocate along the right-left direction 9 (e.g., a scanning direction).

The guide rail 92 (e.g., a support member) may have a plurality of insertion openings 97 e.g., an opening). Protrusions 65, 75 (see FIGS. 6A-6F and 7A-7F) of the contact members 60, 70 may be inserted into the insertion openings 97, respectively. The insertion openings 97 may be spaced in two rows with respect to the front-rear direction 8. One of the two rows of the insertion openings 97 may be disposed in a forward part of the guide rail 92, wherein the insertion openings 97 may be spaced apart with respect to the right-left direction 9. The other of the two rows of the insertion openings 97 may be disposed in a rearward part of the guide rail 92, wherein the insertion openings 97 may be spaced apart with respect to the right-left direction 9. Each of the contact members 60 may comprise four protrusions 65 and each of the contact members 70 may also comprise four protrusions 75. In each of the contact members 60, two of the four protrusions 65 may be inserted into corresponding two of the insertion openings 97 formed in the forward part of the guide rail 92 (hereinafter, also referred to as a front insertion-opening 97) and the rest (e.g., the other two) of the four protrusions 65 may be inserted into corresponding two of the insertion openings 97 formed in the rearward part of the guide rail 92 (hereinafter, also referred to as a rear insertion-opening 97). The protrusions 75 of the contact members 70 may also be inserted into corresponding ones of the insertion openings 97 in a similar manner. The contact members 60, 70 may comprise four protrusions 65, 75 each. Therefore, the guide rail 92 may reliably retain the contact members 60, 70 at four points.

Figure 8A:
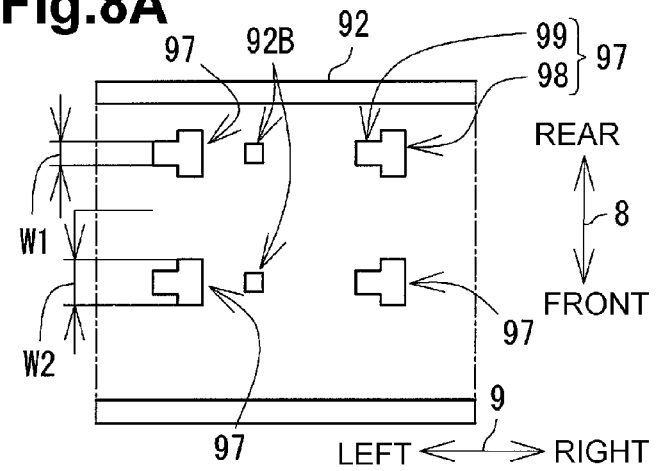
FIG. 8A is a partial plan view depicting a guide rail in the illustrative embodiment according to one or more aspects of the disclosure.
Figure 8B:
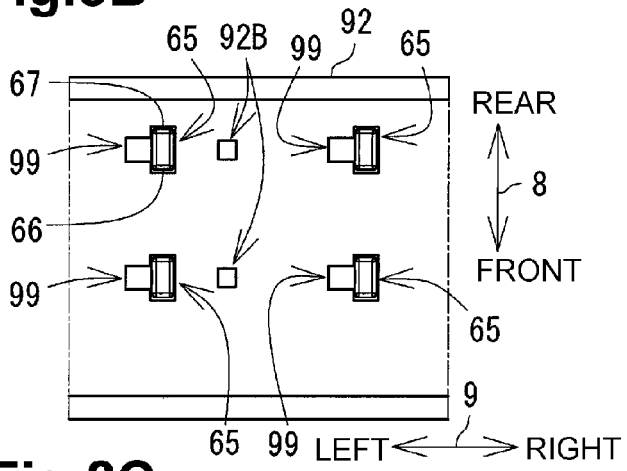
FIG. 8B is a partial plan view depicting the guide rail in the illustrative embodiment according to one or more aspects of the disclosure, wherein protrusions of the one of the contact members are inserted into first openings, respectively.
Figure 8D:
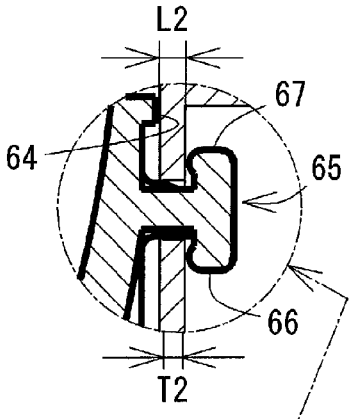
FIG. 8D is a sectional view depicting the guide rail and the one of the contact members attached to the guide rail, taken along a line extending along a front-rear direction, viewed from a direction of arrows D of FIG. 8C, in the illustrative embodiment according to one or more aspects of the disclosure.
Figure 8C:
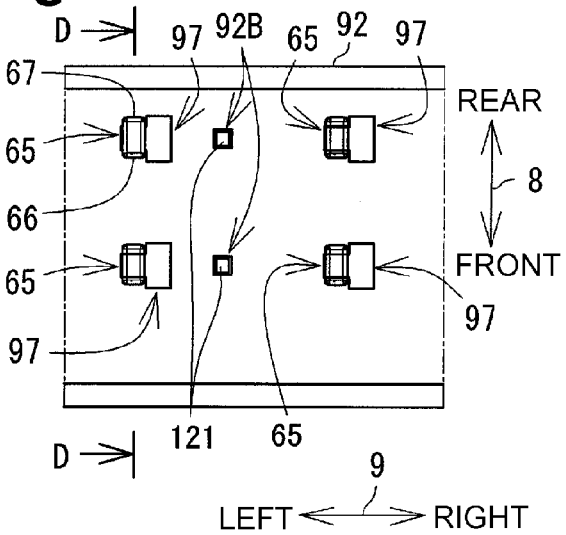
FIG. 8C is a partial plan view depicting the guide rail in the illustrative embodiment according to one or more aspects of the disclosure, wherein the one of the contact members is attached to the guide rail.
Figure 8C:
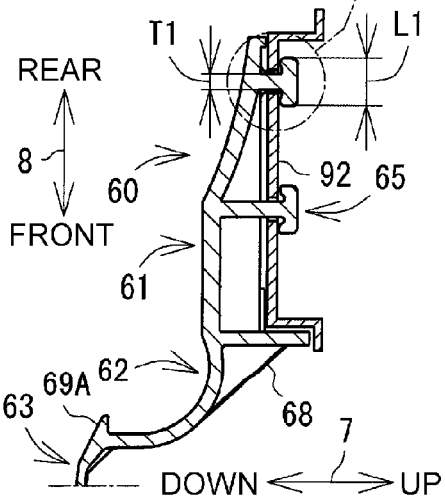

As depicted in FIG. 8A, each of the insertion openings 97 may comprise a first opening 98 and a second opening 99. The first opening 98 may be elongated along the front-rear direction 8. The second opening 99 may be elongated leftward with respect to the right-left direction 9 from a middle portion of the first opening 98 with respect to the front-rear direction 8. As depicted in FIG. 8B, the protrusions 65, 75 may be inserted into the first openings 98, respectively, from below the guide rail 92, and then moved leftward with respect to the right-left direction 9. Thus, the protrusions 65, 75 may be engaged in the second openings 99, respectively, as depicted in FIGS. 8C and 8D.

As depicted in FIG. 5, the guide rail 92 may further include a plurality of insertion openings 92B to lock the contact members 60, 70 with respect to the right-left direction 9. One each of the insertion openings 92B may be provided for each corresponding one of the contact members 60, 70. In the example configuration of FIG. 5, some of the insertion openings are labeled as reference numeral 92B. The insertion openings 92B may each be disposed between adjacent openings of the rear insertion-openings 97 with respect to the front-rear direction 8. Each of the contact members 60, 70 may further comprise a projection 121 that may be engaged with the corresponding one of the insertion openings 92B. Further details are provided below.

As depicted in FIG. 2, the feeding portion 40 may comprise a support shaft 41, an arm 42, and a feed roller 43. The support shaft 41 may be rotatably supported by the lower wall 94 of the frame 91 (see FIG. 4). The arm 42 may extend obliquely downward from the support shaft 41. One end of the arm 42 may be rotatably supported by the support shaft 41 and the other end of the arm 42 may rotatably support the feed roller 43. The arm 42 may comprise a plurality of gears 44 for transmitting the rotation of the support shaft 41 to the feed roller 43.

The arm 42 may be configured to be rotated integrally with the support shaft 41 by a frictional force generated between the support shaft 41 and the arm 42 as the support shaft 41 is rotated by a drive motor (not depicted). Thus, the feed roller 43 may make contact with an uppermost sheet 6 of the one or more sheets 6 held on the main tray 21. The feed roller 43 may be configured to be rotated by the support shaft 41 via the gears 44. As the feed roller 43 is rotated, the one or more sheets 6 may be fed, one by one, rearward along the front-rear direction 8. The incline wall 26 of the main tray 21 may allow the fed sheet 6 to move into the conveying path 31.

As depicted in FIG. 2, the conveying path 31 may be provided to allow the sheet 6 to pass therethrough. The conveying path 31 may be defined by a plurality of guide members (not depicted) and a platen 50. The conveying path 31 may comprise a curved section 32, which is indicated by a dot and dashed line, and a straight section 33, which is indicated by a double-dot and dashed line. The curved section 32 may extend upward from an upper end of the inclined wall 26 of the main tray 21 and be curved toward the front with respect to the front-rear direction 8. The straight section 33 may extend from an end of the curved section 32 toward the front with respect to the front-rear direction 8. The platen 50 may define the straight section 33 from underneath. An image may be recorded on the sheet 6 held on the platen 50.

As depicted in FIG. 2, the platen 50 may have a plate-like shape having a thickness with respect to the up-down direction 7. The platen 50 may be disposed above the lower wall 94 (see FIG. 4) of the frame 91 and below the guide rails 92, 93 (see FIG. 5). As depicted in FIG. 5, the platen 50 may comprise a plurality of support ribs 51 that may upwardly protrude from an upper surface of the platen 50. The support ribs 51 may be provided for holding the sheet 6 thereon. The support ribs 51 may extend along the front-rear direction 8 to hold the sheet 6 being conveyed. The support ribs 51 may be spaced apart from each other with respect to the right-left direction 9 and disposed at diametrically opposed positions about the center line of the platen 50 with respect to the right-left direction 9. This configuration may allow the support ribs 51 to hold various-sized sheets 6, which have been centered by the side guide mechanism 27, at the diametrically opposed positions.

As depicted in FIG. 2, the recording portion 45 may comprise the carriage 48 and a recording head 46 mounted on the carriage 48 while a gap is left above the platen 50, that is, a gap G is left between the recording portion 45 and the platen 50.

As depicted in FIG. 5, the carriage 48 may be disposed between the front edge portion of the bent portion of the guide rail 92 and the rear edge portion of the bent portion of the guide rail 93. The carriage 48 may be supported by the guide rails 92, 93 so as to be able to reciprocate along the right-left direction 9. The carriage 48 may be fixed to a belt (not depicted) that may be disposed on the guide rail 93 so as to be rotatable. The belt may be configured to be rotated by the drive motor (not depicted) to allow the carriage 48 to reciprocate along the right-left direction 9.

Figure 3:
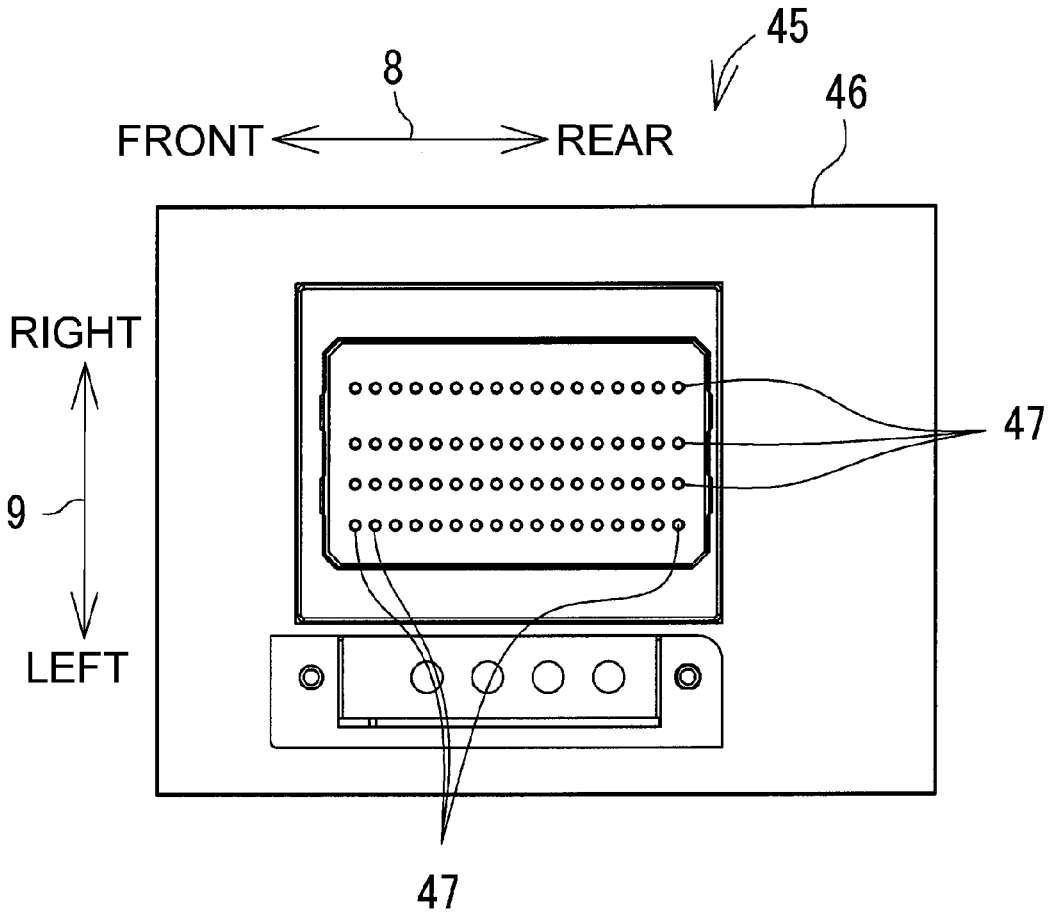
FIG. 3 is a bottom view depicting a recording head in the illustrative embodiment according to one or more aspects of the disclosure.

As depicted in FIG. 2, the recording head 46 may be mounted on the carriage 48 and disposed above the platen 50. As depicted in FIG. 3, the recording head 46 has a plurality of nozzles 47 in a lower surface of the recording head 46 to eject ink droplets therefrom. The recording head 46 may be configured to record an image onto a sheet 6 by ejecting ink droplets from the nozzles 47 onto the sheet 6 held by the platen 50.

As depicted in FIG. 2, the conveyor roller pair 34 (e.g., a conveyor) may be disposed upstream of the platen 50 with respect to the conveying direction 19 (behind the platen 50 with respect to the front-rear direction 8) and below the guide rail 92 (see FIG. 5) while nip points (where the conveyor roller pair 34 may nip a sheet 6) of the conveyor roller pair 34 may be located closer to the platen 50. The conveyor roller pair 34 may comprise a rotating shaft 35A, a conveyor roller 35, and following rollers 36. The rotating shaft 35A may extend along the right-left direction 9 (a direction perpendicular to the drawing sheet of FIG. 2). The conveyor roller 35 may be disposed on the rotating shaft 35A and may be configured to rotate integrally with the rotating shaft 35A. The following rollers 36 may be disposed below the conveyor roller 35. Both end portions of the rotating shaft 35A with respect to the right-left direction 9 may be fitted in the cutaway portions 101, 103, respectively, of the left side-wall 95 and the right side-wall 96 of the frame 91 (see FIG. 4). The rotating shaft 35A may be rotatably supported by the frame 91.

The following rollers 36 may be rotatably supported by a holder (not depicted). The holder may be urged upward by one or more elastic members (not depicted). The following rollers 36 may be in pressure contact with the conveyor roller 35 by urging force of the one or more elastic members. As the rotating shaft 35A is rotated by the drive motor (not depicted), the conveyor roller pair 34 may be configured to nip the sheet 6 by the conveyor roller 35 and the following rollers 36 and convey the sheet 6 along the conveying direction 19.

As depicted in FIG. 2, the discharge roller pair 37 may be disposed downstream of the platen 50 with respect to the conveying direction 19 (e.g., in front of the platen 50 with respect to the front-rear direction 8) and below the guide rail 93 (see FIG. 5). The discharge roller pair 37 may comprise the rotating shaft 38A, the plurality of discharge rollers 38 and a plurality of first spurs 39. The first spurs 39 may be disposed above the discharge rollers 38, respectively. The rotating shaft 38A may extend along the right-left direction 9 (the direction perpendicular to the drawing sheet of FIG. 2). The discharge rollers 38 may be disposed on the rotating shaft 38A and may be configured to be rotated integrally with the rotating shaft 38A. Both end portions of the rotating shaft 38A with respect to the right-left direction 9 may be fitted in the cutaway portions 102, 104 of the left side-wall 95 and the right side-wall 96 of the frame 91 (see FIG. 4). The rotating shaft 38A may be rotatably supported by the frame 91.

The first spurs 39 may be rotatably disposed on elastic shafts (not depicted), respectively. Both end portions of each of the elastic shafts with respect to its axial direction may be supported by the holder (not depicted) held by the guide rail 93. The first spurs 39 may be in pressure contact with the discharge rollers 38, respectively, by the elastic shafts being deformed. As the rotating shaft 38A is rotated by the drive motor (not depicted), the discharge roller pair 37 may be configured to nip and convey the sheet 6 along the conveying direction 19.

The plurality of contact members 60, 70 depicted in FIG. 2 may be provided for reducing the lifting or curling of the sheet 6 being conveyed on the platen 50 by pressing the sheet 6 from above. As depicted in FIG. 5, the plurality of contact members 60 may be spaced apart from each other with respect to the right-left direction 9. The plurality of contact members 60 may be disposed at diametrically opposed positions about the center line of the platen 250 with respect to the right-left direction 9. This configuration may form a corrugated shape in the centered sheet 6 of various sizes such that a corrugated pattern formed in the sheet 206 may be symmetric about the center line of the sheet 6. Hereinafter, the contact members 60 are described in further detail with reference to FIGS. 6A-6F and 8A-8D. All of the contact members 60 may have the same configuration, and therefore, the description may be made with respect to one of the contact members 60. In FIGS. 6A-6F and 8A-8D, the up-down direction 7, the front-rear direction 8 and the right-left direction 9 may be defined while the contact member 60 may be attached to the guide rail 292.

As depicted in FIGS. 6A-6F, the contact member 60 may comprise a fixing portion 61, a curved portion 262, and a contact portion 263. The contact member 60 may be configured to be attached to the guide rail 92 via the fixing portion 61. The curved portion 62 may curvedly extend from the fixing portion 61. The contact portion 63 may extend from the curved portion 62 to the gap G. The contact member 60 may be molded of resin material having elasticity such that the contact portion 63 and an elastic portion 120 (described later) may be deformable elastically. The elastic deformation of the contact portion 63 and the elastic portion 120 will be described in further detail later.

The fixing portion 61 may have a plate-like shape having a thickness with respect to the up-down direction 7. The fixing portion 61 may comprise a plurality of stiffening ribs 64 and a plurality of, for example, four, protrusions 65. The stiffening ribs 64 and the protrusions 65 may upwardly protrude from an upper surface of the fixing portion 261. The four protrusions 65 may be configured to be inserted into the respective insertion openings 97 (see FIG. 8A) of the guide rail 92. Two each of the four protrusions 65 may be arranged with respect to the front-rear direction 208 and the right-left direction 209.

As depicted in FIGS. 6A-6F, each of the protrusions 65 may comprise a pair of front and rear pawls 66, 67 at its protruding end (an upper end). The pair of pawls 66, 67 may engage the upper surface of the guide rail 92. The pawl 66 may protrude forward from the protruding end (e.g., the upper end) of each of the protrusions 65 with respect to the front-rear direction 8. The pawl 67 may protrude rearward from the upper end of each of the protrusions 65 with respect to the front-rear direction 8.

The elastic portion 120 may extend rearward from a rear end of the fixing portion 61 with respect to the front-rear direction 8. The elastic portion 120 may have a plate-like shape and elasticity with respect to the up-down direction 7. The elastic portion 120 may comprise the projection 121 on an upper surface of a protruding end portion of the elastic portion 120 (e.g., a rear end portion of the elastic portion 120 with respect to the front-rear direction 8). The projection 121 may protrude upward from the elastic portion 120 and be configured to be engaged with the corresponding one of the insertion openings 92B of the guide rail 92.

In order to attach the contact member 60 to the guide rail 92, first, the protrusions 65 may be inserted into the respective first openings 98 from below the guide rail 92 (see FIG. 8B). Then, the contact member 60 may be slid leftward with respect to the right-left direction 9. Therefore, the projection 121 may make contact with a lower surface of the guide rail 92 and the elastic portion 120 may be deformed. When the contact member 60 is further slid leftward and the protrusions 65 are engaged in the respective second openings 6 (see FIGS. 8C and 8D), the projection 121 may be engaged with the corresponding insertion opening 92B by an elastic force of the elastic portion 120. Thus, the contact member 60 may be locked in the guide rail 92 with respect to the right-left direction 9.

A dimensional relationship among the protrusions 65, the pawls 66, 67, and the insertion openings 97 is now described in further detail with reference to FIGS. 8A-8D.

A thickness T1 (see FIG. 8D) of the protrusion 65 with respect to the front-rear direction 8 may be the same or substantially the same as a width W1 (see FIG. 8A) of the second opening 99 with respect to the front-rear direction 8 such that the protrusion 65 may be engaged with and locked in the second opening 99 with respect to the front-rear direction 8. When the contact portion 63 of the contact member 60 is located closer to the nozzles 47 (see FIG. 3), the contact member 60 may press the sheet 6 (see FIG. 2) near the nozzles 47, and thus image-recording accuracy may be improved.

However, when the contact member 60 is deviated from the position with respect to the front-rear direction 8 due to vibrations or jostling, the contact portion 63 of the contact member 60 might not be located at the appropriate position. For example, the contact portion 63 may be located too far from or too close to the nozzles 47. When the contact portion 63 is located too close to the nozzles 47, ink droplets may adhere to the contact portion 63 undesirably. Accordingly, the contact member 60 may be locked in the guide rail 92 with respect to the front-rear direction 8. As a result, the image-recording accuracy may be stably maintained and the undesired adherence of the ink to the contact portion 63 may be reduced.

Figure 9A:
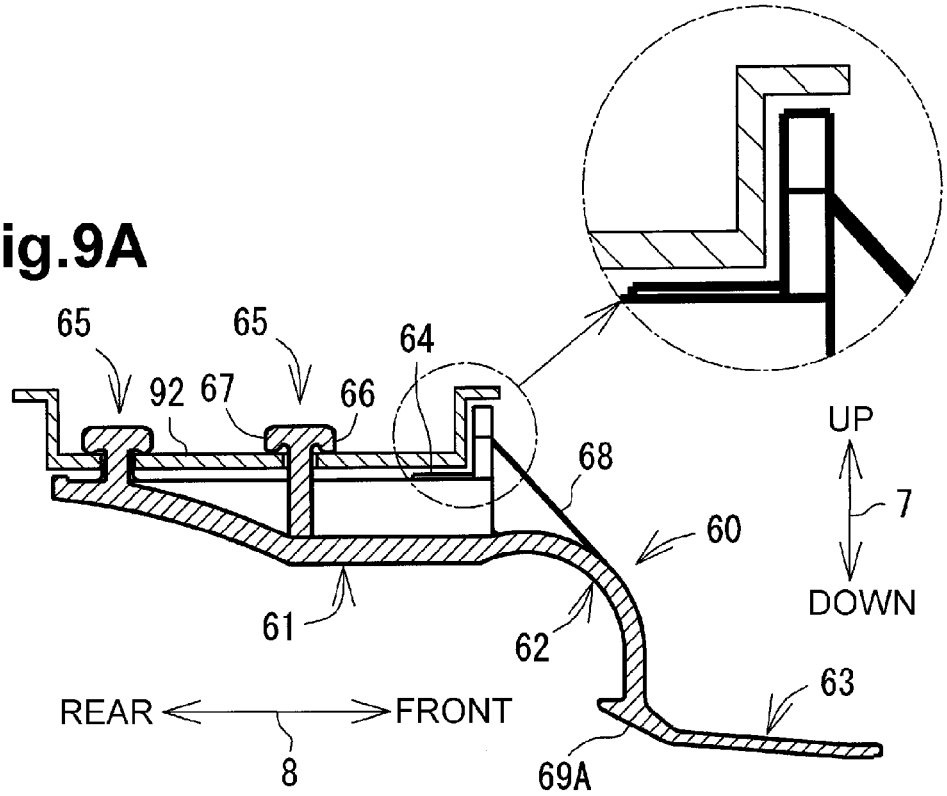
FIG. 9A is a longitudinal sectional view depicting the one of the contact members located in a lower limit position in the illustrative embodiment according to one or more aspects of the disclosure.
Figure 9B:
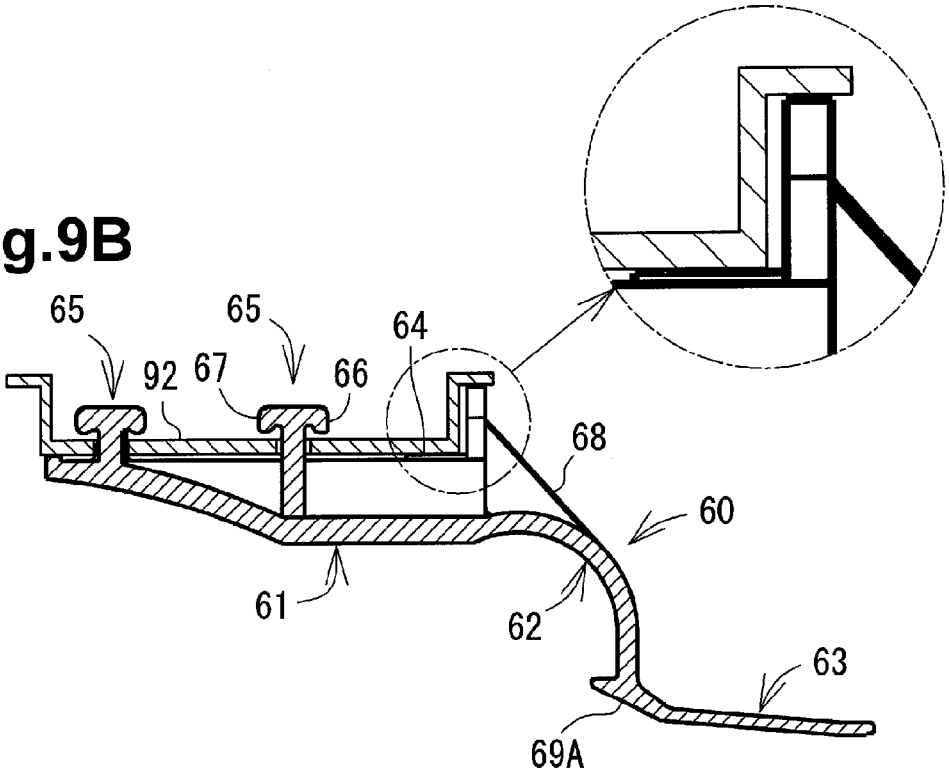
FIG. 9B is a longitudinal section view depicting the one of the contact members located in an upper limit position in the illustrative embodiment according to one or more aspects of the disclosure.

A distance L1 (see FIG. 8D) between a front end of the pawl 66 and a rear end of the pawl 6 with respect to the front-rear direction 8 may be shorter (e.g., slightly shorter) than a width W2 (see FIG. 8A) of the first opening 98 with respect to the front-rear direction 8 such that the protrusion 65 may be inserted into the corresponding first opening 98. In addition, the distance L1 may be greater than the width W1 of the second opening 99 such that the pawls 66, 67 may engage the upper surface of the guide rail 92 when the protrusion 65 is engaged in the corresponding second opening 99. A distance L2 (see an enlarged view of FIG. 8D) between a lower end of each of the pawls 66, 67 and an upper edge of each of the stiffening ribs 64 may be greater than a thickness T2 (see an enlarged view of FIG. 8D) of the guide rail 92 to allow the contact member 60 to move easily along the right-left direction 9 within the corresponding insertion opening 97. Therefore, the contact member 60 may be configured to be movable along the up-down direction 7 between a lower limit position and an upper limit position. When the contact member 60 is located in the upper limit position, the pawls 26, 67 may make contact with the upper surface of the guide rail 92 (see FIG. 9A). When the contact member 60 is located in the upper limit position, the upper edges of the stiffening ribs 64 may make contact with the lower surface of the guide rail 92 (see FIG. 9B). The distance L2 may be determined such that the contact portion 63 is not able to make contact with the upper surface of the platen 50 when located in the lower limit position and the contact portion 63 is located higher the support ribs 51 and lower than a lower surface of the recording portion 50 when located in the upper limit position. As depicted in the enlarged view of FIG. 8D, lower end surfaces of the pawls 66, 67 may be formed in an arc shape. This configuration may reduce a contact area between the guide rail 92 and each of the pawls 66, 67 to allow the contact member 60 to move easily along the right-left direction 9.

As described above, the contact member 60 may be locked in the guide rail 92 so as not to be movable along the front-rear direction 8 and the right-left direction 9 but may be movable (e.g., slightly movable) along the up-down direction 7. The contact member 60 may be located in the lower limit position under its own weight when no external force is applied to the contact member 60. When the sheet 6 being conveyed makes contact with the contact portion 63, the contact member 60 may be moved from the lower limit position depicted in FIG. 9A to the upper limit position depicted in FIG. 9B by the sheet 6. This configuration will be described in further detail below.

Figure 6B:
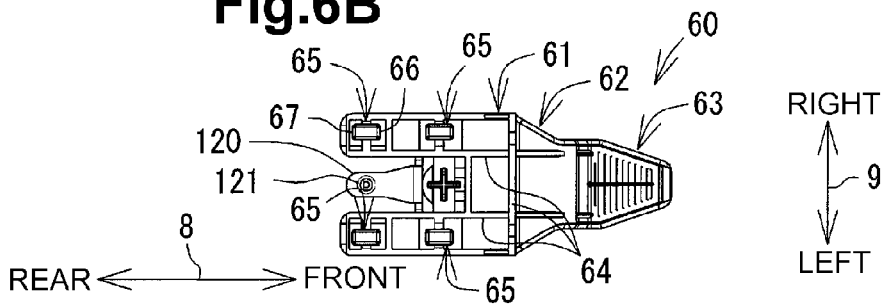
FIG. 6B is a plan view depicting the one of the contact members in the illustrative embodiment according to one or more aspects of the disclosure.
Figure 6C:
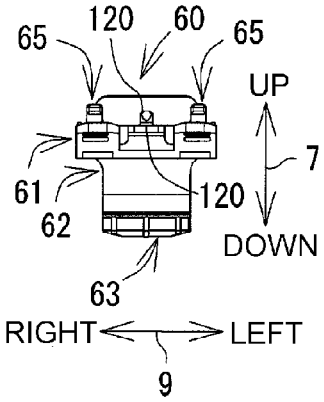
FIG. 6C is a back view depicting the one of the contact members in the illustrative embodiment according to one or more aspects of the disclosure.
Figure 6A:
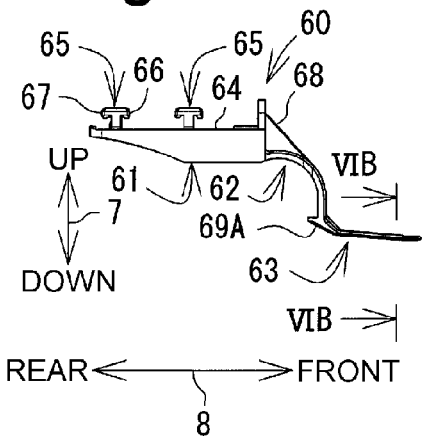
FIG. 6A is a side view depicting one of contact members in the illustrative embodiment according to one or more aspects of the disclosure.
Figure 6D:
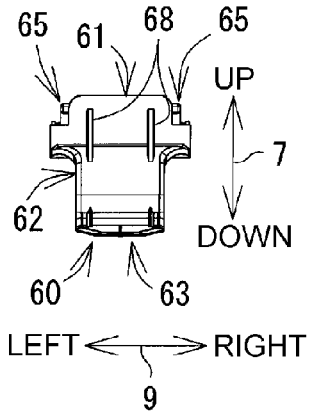
FIG. 6D is a front view depicting the one of the contact members in the illustrative embodiment according to one or more aspects of the disclosure.
Figure 6F:
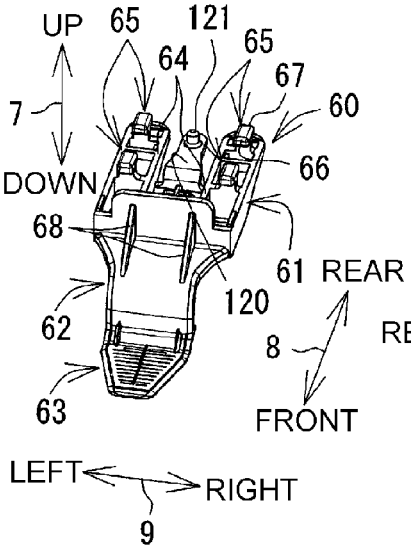
FIG. 6F is a perspective view depicting the one of the contact members in the illustrative embodiment according to one or more aspects of the disclosure
Figure 6E:
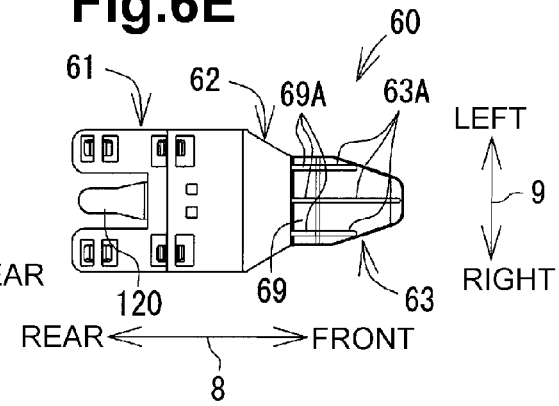
FIG. 6E is a bottom view depicting the one of the contact members in the illustrative embodiment according to one or more aspects of the disclosure.
Figure 7B:
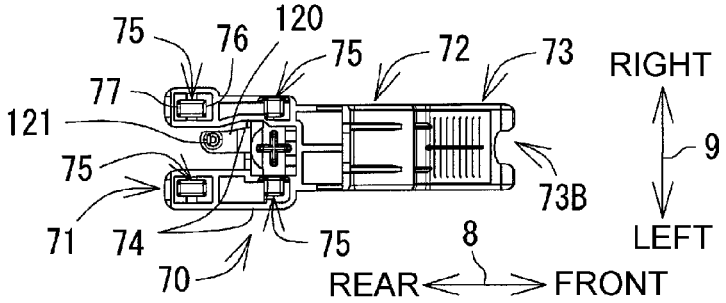
FIG. 7B is a plan view depicting the another one of the contact members in the illustrative embodiment according to one or more aspects of the disclosure.
Figure 7C:
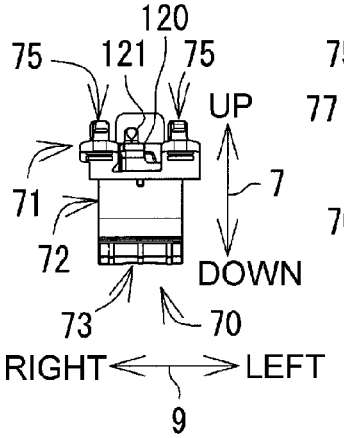
FIG. 7C is a back view depicting the another one of the contact members in the illustrative embodiment according to one or more aspects of the disclosure.
Figure 7A:
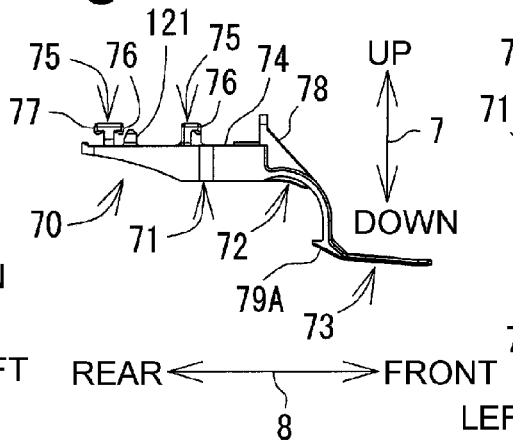
FIG. 7A is a side view depicting another one of the contact members in the illustrative embodiment according to one or more aspects of the disclosure.
Figure 7D:
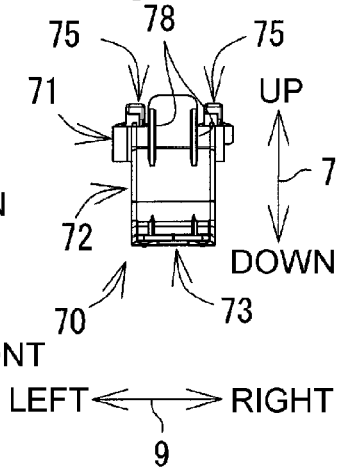
FIG. 7D is a front view depicting the another one of the contact members in the illustrative embodiment according to one or more aspects of the disclosure.
Figure 7F:
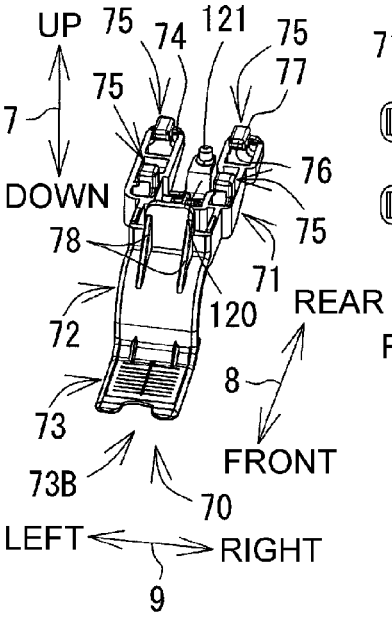
FIG. 7F is a perspective view depicting the another one of the contact members in the illustrative embodiment according to one or more aspects of the disclosure.
Figure 7E:
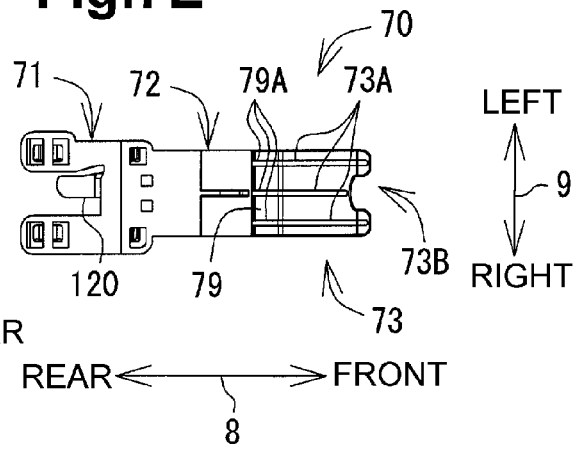
FIG. 7E is a bottom view depicting the another one of the contact members in the illustrative embodiment according to one or more aspects of the disclosure.

As depicted in FIG. 6A, the curved portion 62 may extend downward and be curved into an arc shape. This configuration may avoid contact between the curved portion 62 of the contact member 60 and the conveyor roller 35 (see FIG. 5) disposed below the guide rail 92 (see FIG. 5). The curved portion 62 may be reinforced with stiffening ribs 68 to reduce its deformation.

The curved portion 62 may comprise a guide portion 69 at its lower end. The guide portion 69 may be provided for guiding a downstream edge (e.g., also referred to as a leading edge of the sheet 6) of the sheet 6 being conveyed with respect to the conveying direction 19 to the contact portion 63. For example, the guide portion 69 of the curved portion 62 may protrude from the curved portion 62 toward a nip point of the conveyor roller pair 34, and may comprise an inclined surface at a lower surface of the protruding part. The inclined surface of the guide portion 69 may be inclined downwardly toward the front. The guide portion 69 may comprise a plurality of, for example, three, guide ribs 96A at its lower surface. The guide ribs 96A may downwardly protrude from the lower surface of the guide portion 69 and extend along a direction that the guide portion 69 may extend (e.g., a downwardly oblique direction). The guide ribs 96A may be disposed at the center and at both sides with respect to the right-left direction 9 on the lower surface of the guide portion 69. The leading edge of the sheet 6 conveyed by the conveyor roller pair 34 may be made contact with protruding edges (e.g., lower edges) of the guide ribs 96A and then guided to the contact portion 63.

Figure 11:
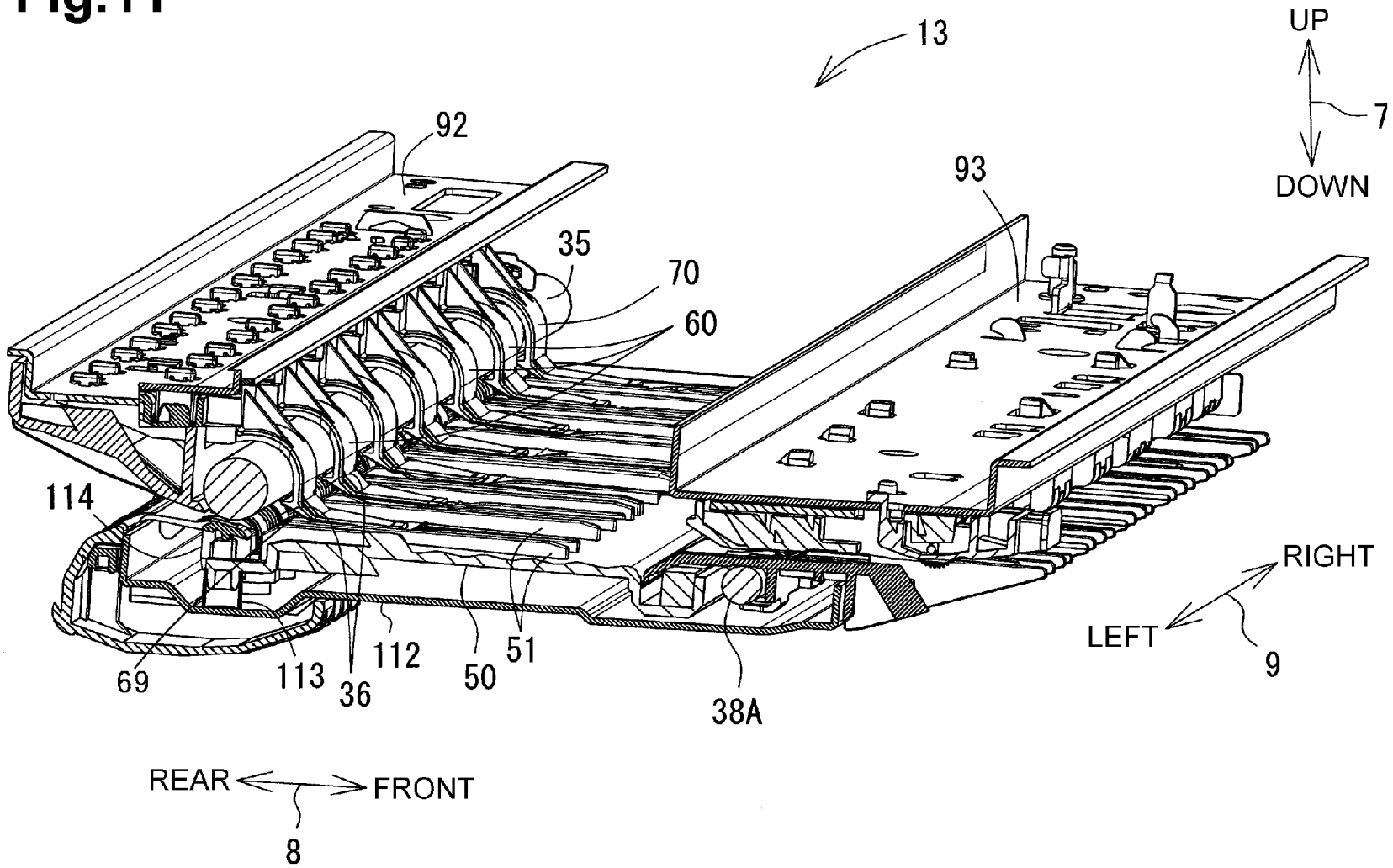
FIG. 11 is a cutaway side perspective view depicting a main body in a second variation of the illustrative embodiment according to one or more aspects of the disclosure.
Figure 14:
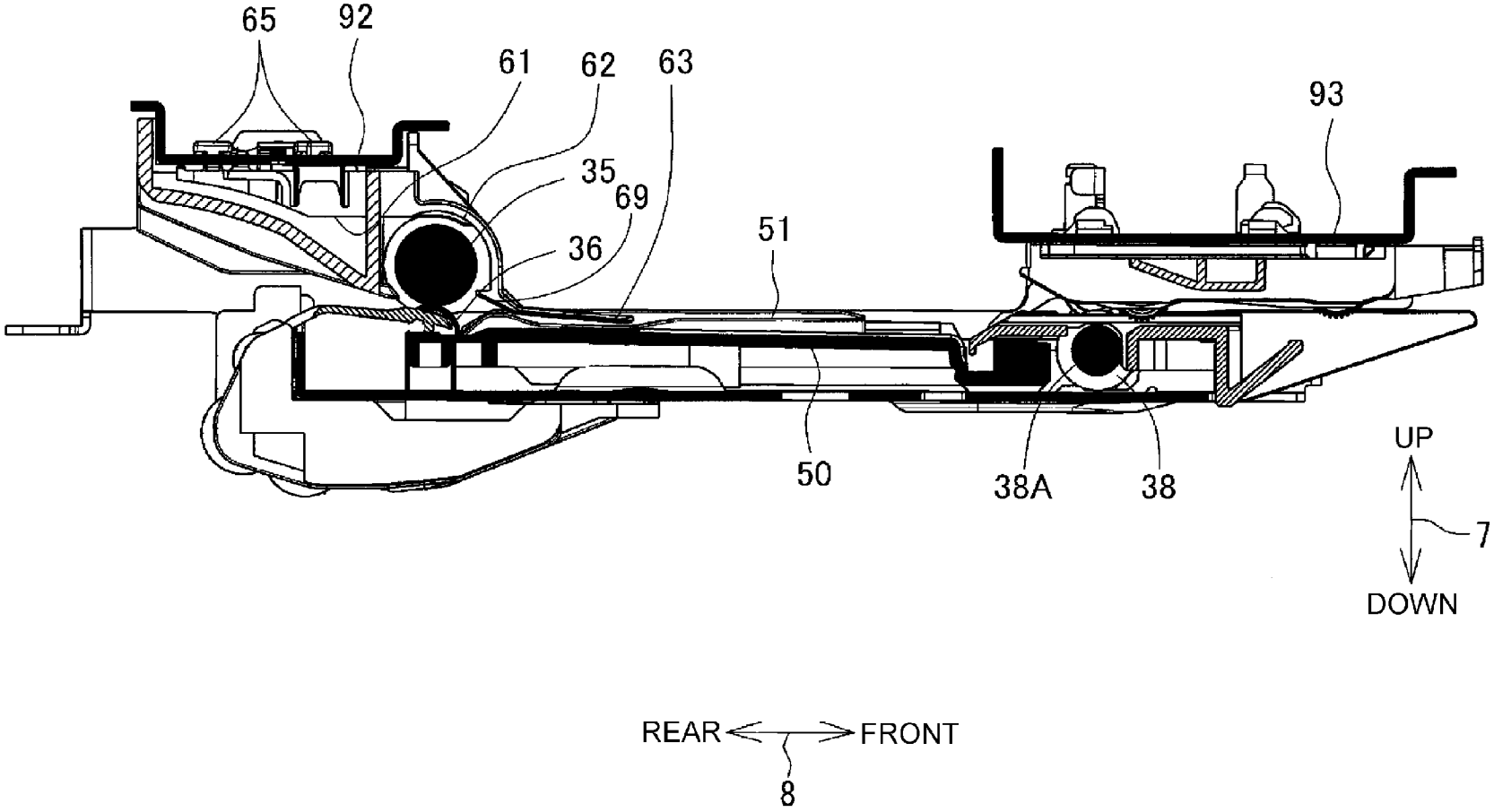
FIG. 14 is a longitudinal sectional view depicting the platen and its surroundings in a printer unit in the illustrative embodiment according to one or more aspects of the disclosure.

As depicted in FIGS. 11 and 14, the guide portion 69 of the curved portion 62 may protrude from the curved portion 62 such that the guide portion 69 may be located closer to the nip point of the conveyor roller pair 34. While the contact member 60 is attached to the guide rail 92, the guide portion 69 may protrude to a position upstream of a downstream end of the conveyor roller 35 with respect to the conveying direction 19. For example, the guide portion 69 may protrude to a position where a most protruding portion of a roller surface of the conveyor roller 35 protruding toward the downstream of the conveying direction 19 is located. Therefore, while the conveyor roller pair 34 conveys the sheet 6 onto the platen 50, the guide portion 69 may allow the leading edge of the sheet 6 to move to the contact portion 63 without the sheet 6 entering between the conveyor roller 35 and the curved portion 62 of the contact member 60. Thus the contact portion 63 of the contact member may press a surface of the sheet 6 facing the recording head 46 toward the platen 50.

As depicted in FIGS. 6A-6E, the contact portion 63 may have a plate-like shape and may extend obliquely downward from the front of the lower end of the curved portion 62 with respect to the front-rear direction 8. The contact portion 63 may be inclined with respect to a horizontal surface such that a more forward part of the contact portion 63 may become closer to the upper surface of the platen 50. A front end of the contact portion 63 with respect to the front-rear direction 8 may be located near the nozzles 47 wherein the front end of the contact portion 63 may be located behind the nozzles 47 (see FIG. 3) of the recording head 46 with respect to the front-rear direction 8 (e.g., upstream of the nozzles 47 of the recording head 46 with respect to the conveying direction 19) and in front of a rear end of the carriage 48 with respect to the front-rear direction 8 (e.g., downstream of the rear end of the carriage 48 with respect to the conveying direction 19). The plurality of contact members 60 may be attached to the guide rail 92 such that the contact portions 63 of the contact members 60 may be located at the same respective positions with respect to the up-down direction 7 and the front-rear direction 8.

The contact portion 63 of the contact member 60 may be inclined. With this configuration, the contact portion 63 may allow the leading edge of the sheet 6 (see FIG. 2) to move to the front end of the contact portion 63 with respect to the front-rear direction 8. Additionally or alternatively, the contact portion 63 may have a plate-like shape. With this configuration, the front end of the contact portion 63 may be located in the gap G (see FIG. 2) in which a thickness, with respect to the up-down direction 7, may be reduced or minimized while maintaining an appropriate strength of the contact portion 63. The front end of the contact portion 63 with respect to the front-rear direction 8 may be located near the nozzles 47 (see FIG. 3). With this configuration, the contact portion 63 may be allowed to press the sheet 6 near the nozzles 47 and thus the image-recording accuracy may be improved.

The contact portion 63 may be tapered toward the front end with respect to the front-rear direction 8 such that both edges of the contact portion 63 with respect to the right-left direction 9 may become closer to each other toward the front with respect to the front-rear direction 8. With this configuration, a forward part of the contact portion 63 with respect to the front-rear direction 8 may be deformed to reduce an occurrence of a paper jam between the contact portion 63 and the platen 50 (see FIG. 2) when a sheet 6 having relatively greater thickness is conveyed.

A more forward part of the contact portion 63 may have a thinner thickness with respect to the front-rear direction 8. With this configuration, the forward part of the contact portion 63 is deformable when forming the sheet 6 being conveyed into the corrugated shape. The forward part of the contact portion 63 may be configured to be deformable to adjust the shape of a curve of the corrugated pattern formed in the sheet 6. When a sheet 6 having relatively greater thickness is conveyed, the forward part of the contact portion 63 may be deformed to reduce an occurrence of jamming of the sheet 6 between the contact portion 63 and the platen 50. As described above, the forward part of the contact portion 63 may have a smaller thickness. Therefore, a gap between a nozzle surface (e.g., the lower surface) of the recording head 46 and the contact portion 63 may become greater. This configuration may prevent the contact portion 63 and the recording head 46 from coming into contact with each other. Further, this configuration may facilitate a removal of the sheet 6 jammed at the contact portions 63.

The contact portion 63 may comprise a plurality of, for example, three, contact ribs 6 at its lower surface. The contact ribs 63A may protrude downward from the lower surface of the contact portion 63 and extend along a direction that the contact portion 63 may extend (obliquely downward toward the front). The contact ribs 63A may be disposed at the center and both sides of the contact portion 63 with respect to the right-left direction 9. The contact ribs 63A may be connected with the respective guide ribs 96A of the guide portion 69 of the curved portion 62. The contact ribs 63A may come into contact with an upper surface of the sheet 6 being conveyed and press the sheet 6 (see FIG. 2) from above. The provision of the contact ribs 63A may reduce a contact area between the contact member 60 and the sheet 6, and thus, the conveyance resistance to the sheet 6 may become smaller. Therefore, the image-recording accuracy may be improved.

As depicted in FIG. 5, the contact member 70 may be disposed above the platen 50 and at each end portion of the platen 50 with respect to the right-left direction 9. Therefore, the contact members 70 may have a shape that may be different from the shape of the contact members 60. Hereinafter, the contact members 70 are described in detail with reference to FIGS. 7A-7F. In various arrangements, both of the contact members 70 may have the same configuration, and therefore, the description may be made with respect to one of the contact members 70. In FIGS. 7A-7F, the up-down direction 7, the front-rear direction 8 and the right-left direction 9 may be defined while the contact member 70 may be attached to the guide rail 92.

The contact member 70 may comprise a fixing portion 71, a curved portion 72, and a contact portion 73. Similar to the contact member 60, the fixing portion 27 may comprise stiffening ribs 74, the protrusions 75, an elastic portion 120, and a projection 121. The fixing portion 71 may have the same or substantially the same configuration as the fixing portion 61 of the contact member 60 except that the front protrusions 275 with respect to the front-rear direction 8 may not comprise pawls 77, respectively. The omission of the pawls 77 of the front protrusions 75 may prevent interference between the pawls 77 and other members or portions. The fixing portion 71 may be attached to the guide rail 92 via the four protrusions 75, pawls 76, 77 of the protrusions 75 and the stiffening ribs 74 in a similar manner to the fixing portion 61 of the contact member 60.

The curved portion 72 may comprise stiffening ribs 78, a guide portion 79 and guide ribs 79A. The curved portion 72 of the contact member 70 may have the same or substantially the same shape as the curved portion 62 of the contact member 20.

The contact portion 73 may have a substantially rectangular-plate-like shape. The contact portion 73 may be inclined with respect to the horizontal surface such that its front end may be located lower than its rear end with respect to the front-rear direction 8. The front end (lower end) of the contact portion 73 with respect to the front-rear direction 8 may be located at the same position with respect to the up-down direction 7 and the front-rear direction 208 as the front end (lower end) of the contact portion 63 with respect to the front-rear direction 8 when the contact members 60, 70 are attached to the guide rail 92. The contact portion 73 may comprise a plurality of, for example, three, contact ribs 73A at a lower surface of the contact portion 73. The contact ribs 73A may protrude downward from the lower surface of the contact portion 73 and extend along a direction that the contact portion 73 may be inclined (obliquely downward toward the front). The contact ribs 73A may be disposed at the center and both sides of the contact portion 73 with respect to the right-left direction 9. The contact ribs 73A may be connected with the respective guide ribs 79A of the curved portion 72. The contact ribs 73A may come into contact with an upper surface of the sheet 6 being conveyed and press the sheet 6 from above.

The contact member 70 may be attached to the guide rail 92 such that one of right and left edges of the sheet 6 (e.g., A4-size paper or legal-size paper) with respect to the right-left direction 9 may pass between adjacent two of the plurality of contact ribs 73A. Therefore, in some cases, the sheet 6 may make contact with one of the contact ribs 73A with respect to the right-left direction 9. If the contact portion 73 is tapered toward the front end like the contact portion 63 of the contact member 60, the contact portion 73 may not be able to press the sheet 6 near the nozzle 47 (see FIG. 3). In view of the above circumstances, the contact portion 73 may not be tapered but have a substantially rectangular-plate-like shape. The contact member 70 may be configured to press the sheet 6 by one or more of the contact ribs 73A at each position inside either of the right and left edges of the sheet 6 with respect to the right-left direction 9 until the sheet 206 is conveyed to the vicinity of the nozzles 47. The contact portion 73 may have a cutaway portion 73B at a middle portion with respect to the right-left direction 9 of a forward part of the contact portion 73 with respect to the front-rear direction 8. The contact portion 73 may be partially cut away from its front edge toward the rear to define the cutaway portion 73B. The front end of the contact rib 73A that may protrude at the center of the contact portion 73 with respect to the right-left direction 9 may be located further to the rear than front ends of the other contact ribs 73A that may protrude at either side of the center contact rib 73A.

As described above, the forward part of the contact portion 73 may have a smaller thickness. Therefore, the forward part of the contact portion 73 may be deformable when forming the sheet 6 being conveyed into the corrugated shape. The forward part of the contact portion 73 may be configured to be deformable to adjust the shape of a curve of the corrugated pattern formed in the sheet 6. When a sheet 6 having relatively greater thickness is conveyed, the forward part of the contact portion 73 may be deformed to reduce an occurrence of jamming of the sheet 6 between the contact portion 73 and the platen 50. As described above, the forward part of the contact portion 273 may have a thinner thickness. Therefore, a gap between the nozzle surface (e.g., the lower surface) of the recording head 46 and the contact portion 273 may become greater. This configuration may not allow the contact portion 73 and the recording head 46 to come into contact with each other. Further, this configuration may facilitate a removal of the sheet 6 jammed at the contact portions 73.

An operation of the inkjet recording apparatus 10 is now described with reference to FIG. 2. The feed roller 42 may feed, one by one, one or more sheets 6 placed in the main tray 21, into the conveying path 31. Then the conveyor roller pair 34 may convey the one or more fed sheets 6 successively. The guide ribs 69A, 79A of the contact members 60, 70 may guide a leading edge of the sheet 6 that has passed the nip points of the conveyor roller pair 34 to the contact portions 63, 73. The contact members 60, 70 located in the lower limit position (see FIG. 9A) may be moved to the upper limit position (see FIG. 9B) by the sheet 6. The contact members 60, 70 located in the upper limit position may press the sheet 6 by the contact ribs 63A, 73A of the contact portions 63, 73 from above to reduce the lifting or curling of the sheet 6 on the platen 50. When the leading edge of the sheet being conveyed reaches the position under the nozzles 47 (see FIG. 3) of the recording head 46 under this condition, the conveyor roller 35 may stop rotating. After that, the recording head 46 may eject ink droplets from the nozzles 47 onto the sheet 6 to perform a single line of printing while the carriage 48 may reciprocate along the right-left direction 9. After the recording head 49 performed the single line of printing, the conveyor roller 35 may be allowed to start rotating again to convey the sheet 6 by a single line to start next single line of printing in a new line. The inkjet recording apparatus 10 may record an image on the sheet 6 by alternately performing a single line of printing and performing a line feed. After completing the image recording onto the sheet 6, the inkjet recording apparatus 10 may discharge the sheet 6 onto the sheet discharge tray 29 by the discharge roller pair 37. After the trailing edge of the sheet 6 passes the contact members 60, 70, the contact members 60, 70 located in the upper position may move back to the lower limit position under their own weight.

In the illustrative embodiment, the contact members 60, 70 may be disposed on the guide rail 92 that may support the recording portion 45. Therefore, when the recording portion 45 is moved downward due to deformation of the guide rail 92 or downward displacement of the guide rail 92, the contact members 60, 70 may also move downward in accordance with the downward movement of the recording portion 45. Therefore, this configuration may reduce an occurrence (e.g., a likelihood) of the contact between the recording portion 45 and the contact portions 63, 73 that may be caused by the deformation of the guide rail 92. As a result, this configuration may reduce an occurrence (e.g., a likelihood) of ink adhering to the contact members 60, 70 and/or the unsmoothed reciprocation of the recording portion 45 with respect to the right-left direction 9 that may caused by the contact between the recording portion 45 and the contact members 60, 70.

In the illustrative embodiment, the plurality of contact members 60, 70 may be spaced apart from each other with respect to the right-left direction 9. Therefore, the contact members 60, 70 may be able to press a sheet 6 of any size. In other embodiments, for example, a contact member that may comprise a plurality of contact portions 63 may be disposed so as to extend along the right-left direction 9. However, if the contact member is configured not to be deformable in accordance with the deformation of the guide rail 92, the distance between the recording portion 45 and each of the contact portions 63 may vary and thus the recording portion 45 and one or more of the contact portions 63 may make contact with each other. In contrast to this, in the above-described illustrative embodiment, the plurality of contact members 60, 70 may be disposed as described above. Such a configuration may reduce the lifting or curling of the sheet 6 of any size on the platen 50 and the contact between the recording portion 45 and the contact portions 63.

In the illustrative embodiment, each of the contact members 60, 70 may be attached to the guide rail 92 via the protrusions 65, 75 and the projection 121. Therefore, a parts count may be reduced as compared to a configuration where each of the contact members 60, 70 is attached to the guide rail 92 by fasteners, for example, screws. Further, this configuration may facilitate the attaching of the contact members 60, 70 to the guide rail 92. The contact members 60, 70 may be configured to be movable along the up-down direction 7. With this configuration, when the contact members 60, 70 are located in the upper limit position, a vertical position of the contact portions 63, 73 may be properly positioned with reference to the guide rail 92. As described above, the illustrative embodiment may accomplish the reduction of the parts count, the facilitation of the attaching of the contact members 60, 70 to the guide rail 92, and proper vertical positioning of the contact portions 63, 73.

When a paper jam occurs at the contact portions 63, 73 and a sheet 6 is pulled upward to be removed therefrom, the guide rail 92 may absorb at least a portion of the force that may act on the contact members 60, 70. Therefore, damage to (e.g., breakage of) the contact members 60, 70 may be reduced.

A first variation of the illustrative embodiment is now described. In the above-described illustrative embodiment, the lower ends of the contact portions 63, 73 of the contact members 60, 70 located in the upper limit position (see FIG. 9B) may be located higher than the upper edges of the support ribs 51. In the first variation, when the contact members 60, 70 are located in the upper limit position, the lower ends of the contact portions 63, 73 may be located lower than the upper edges of the support ribs 51. Additionally, a sheet 6 having relatively lower stiffness, for example, plain paper, may be conveyed while being formed in a shape of alternate ridge portions and groove portions (a corrugated shape) by the contact portions 63, 73 and the support ribs 51. The sheet 6 may be formed into the corrugated shape to increase the stiffness of the sheet 6. A corrugated pattern formed in the sheet 6 may reduce the lifting or curling of the sheet 6 on the platen 50. Therefore, the image-recording accuracy may be improved.

Figure 10A:
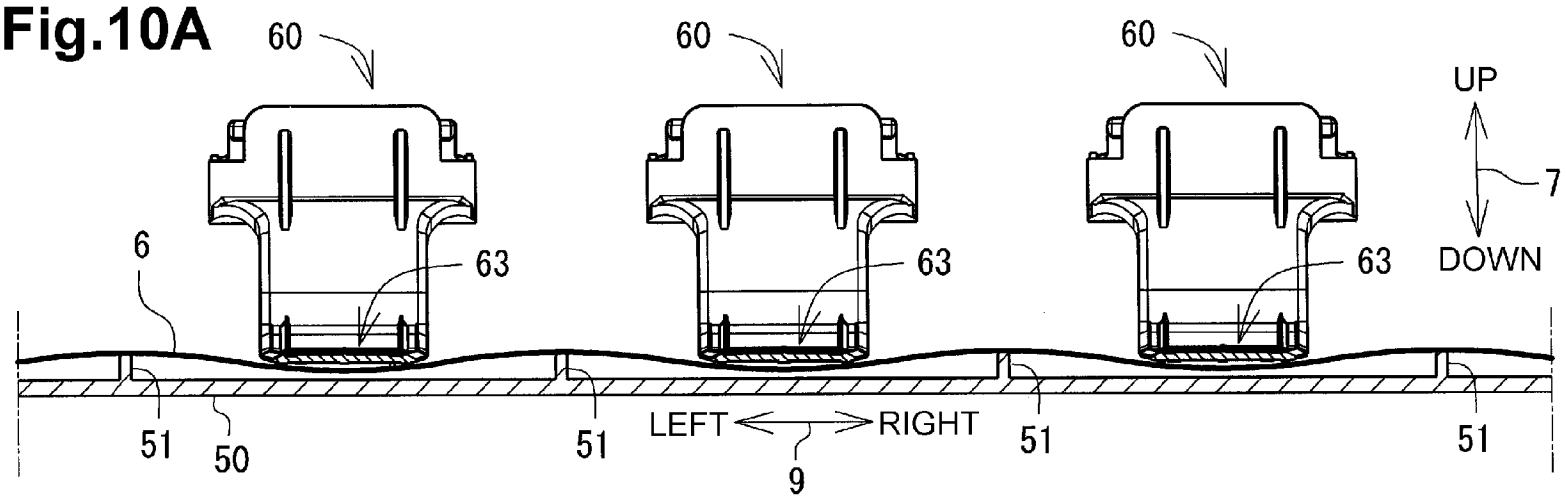
FIG. 10A is a sectional view depicting a platen, taken along a line extending along a right-left direction in a first variation of the illustrative embodiment according to one or more aspects of the disclosure.

As depicted in FIG. 10A, in order to form a corrugated shape in a sheet 6 being conveyed, the support ribs 51 of the platen 50 may be disposed such that the protruding edges (e.g., the upper edges) of the support ribs 51 may be located higher than the lower ends of the contact ribs 63A, 73A (e.g., the front ends of the contact ribs 63A, 73A with respect to the front-rear direction 8) when the contact members 60, 70 are located in the upper limit position. While the sheet 6 passes the contact portions 63, 73, the sheet 6 being conveyed may be held by the support ribs 51 and depressed by the contact ribs 63A, 73A of the contact portions, 63, 73. Thus, the sheet 6 may be formed into the corrugated shape in which the sheet 6 may have ridge portions that may be held by the support ribs 51 and groove portions that may be depressed by the contact ribs 63A, 73A. The corrugated sheet 6 may be conveyed over the platen 50 while being kept from lifting or curling upward.

Each of the support ribs 51 may be disposed between respective adjacent contact members 60 arranged along the right-left direction 9. In such an example arrangement, all distances between a top of the ridge portion and a bottom of the groove portion along the right-left direction 9 in the corrugated pattern formed in the sheet 6 may be the same. Thus, control of the recording head 46 may be facilitated. The recording head 46 may be configured to eject ink droplets in consideration of a changeable (e.g., periodically) distance between each of the nozzles 47 (see FIG. 3) and the sheet 6 due to the corrugation pattern formed in the sheet 6. This configuration may improve the image-recording accuracy. Accordingly, the distance between a top of a ridge portion and a bottom of a groove portion of each curve in the corrugation pattern along the right-left direction 9 may become the same distance. Thus, the control of the recording head 46 may be facilitated.

A second variation of the illustrative embodiment is now described. In the second variation, the platen 50 may be configured to be pivotable so as to record an image onto a sheet 6 having relatively higher stiffness, for example, glossy paper or thicker paper, as well as a sheet 6 having relatively lower stiffness, for example, plain paper, in addition to the configuration according to the first variation. As depicted in FIG. 11, the platen 50 may be pivotably supported by the rotating shaft 38A of the discharge rollers 38 at the front end of the platen 50 with respect to the front-rear direction 8. Therefore, the rearward part of the platen 50 with respect to the front-rear direction 8 may be configured to be movable up and down. The platen 50 may be pivotable between a first position depicted in FIG. 10A and a second position depicted in FIG. 10B. When the platen 50 is located in the first position, the upper edges of the support ribs 51 may be located higher than the lower ends of the contact portions 63, 73 (e.g., the front ends of the contact portions 63, 73 with respect to the front-rear direction 8) of the contact members 60, 70 located in the upper limit position. When the platen 50 is located in the second position, the upper edges of the support ribs 51 may be located lower than the lower ends of the contact portions 63, 73 of the contact members 60, 70 located in the upper limit position.

As depicted in FIG. 11, coil springs 113 (e.g., an urging member) may be disposed under the rear end of the platen 50 with respect to the front-rear direction 8. The coil springs 133 may be configured to urge the platen 50 toward the first position (e.g., upward). Lower ends of the coil springs 113 may be in contact with and supported by a middle wall 112 disposed above the lower wall 94 of the frame 91. Upper ends of the coil springs 113 may be in contact with the lower surface of the platen 50. The platen 50 may be in contact with the holder 114 for rotatably supporting the following rollers 36 and located in the first position while being urged toward the first position (e.g., upward) by the coil springs 113.

Figure 10B:
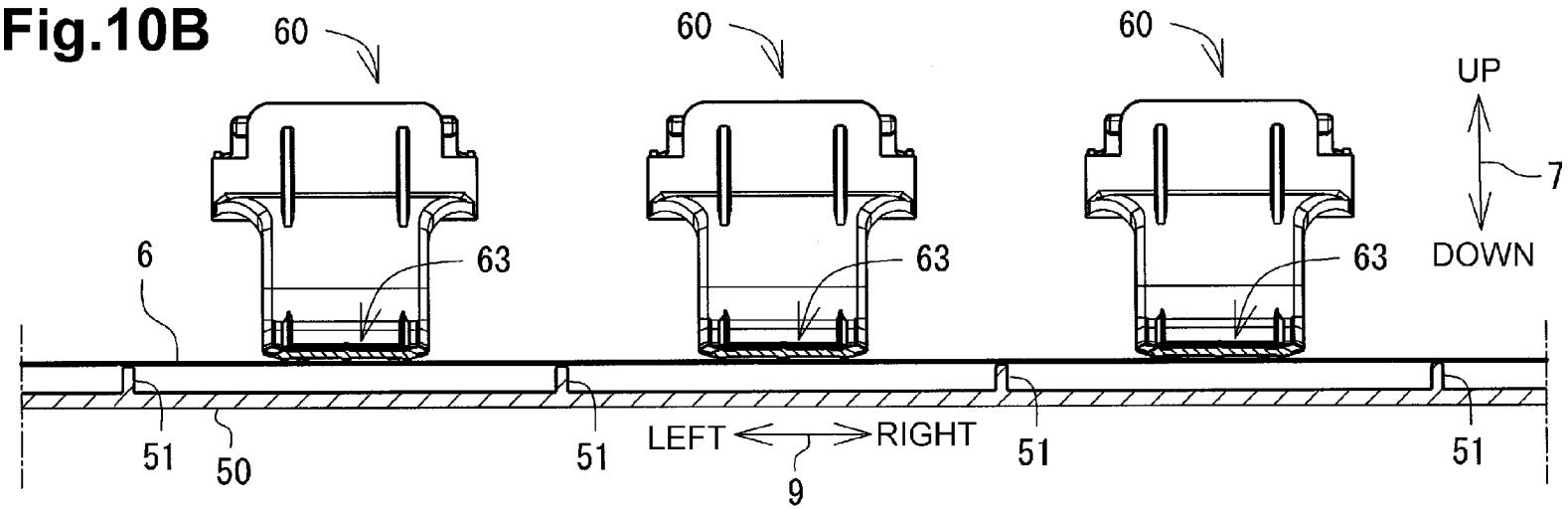
FIG. 10B is a sectional view depicting the platen located in a second position, taken along the line extending along a right-left direction in the first variation of the illustrative embodiment according to one or more aspects of the disclosure.

As depicted in FIG. 10B, when a sheet 6 having relatively higher stiffness is conveyed, the platen 50 may be pivoted from the first position to the second position by the sheet 6. The sheet 6 may allow the platen 50 to stay in the second position and thus the sheet 6 be conveyed without being formed into a corrugated shape. The platen 50 located in the second position may be moved back to the first position by an urging force of the coil springs 113 (see FIG. 11) after the sheet 6 passes the contact members 60, 70.

Figure 12A:
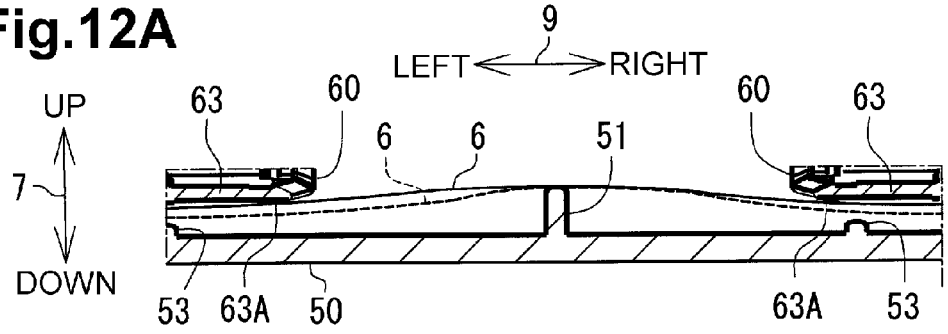
FIG. 12A is an operation explanatory view of the second variation of the illustrative embodiment according to one or more aspects of the disclosure, wherein a cross-sectional view depicting the platen taken along the line extending along the right-left direction is illustrated.
Figure 12B:
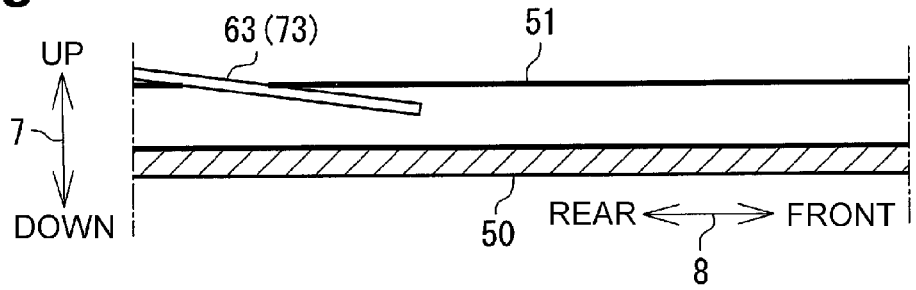
FIG. 12B is an operation explanatory view of the second variation of the illustrative embodiment according to one or more aspects of the disclosure, wherein a cross-sectional view of the platen located in a first position, taken along the line extending along the right-left direction, is illustrated.
Figure 12C:
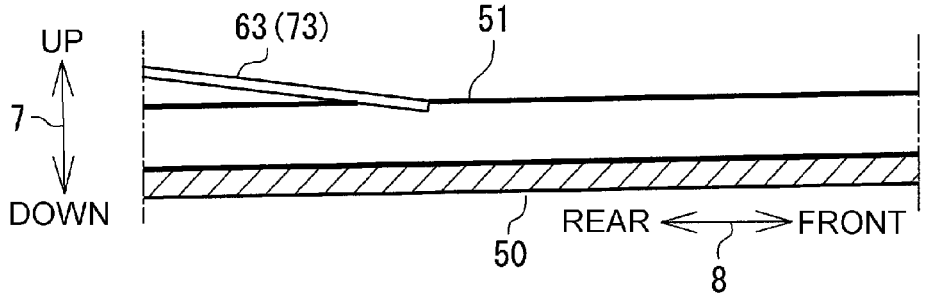
FIG. 12C is an operation explanatory view of the second variation of the illustrative embodiment according to one or more aspects of the disclosure, wherein a cross-sectional view of the platen located in a position between the first position and a second position, taken along the line extending along the right-left direction, is illustrated.
Figure 12D:
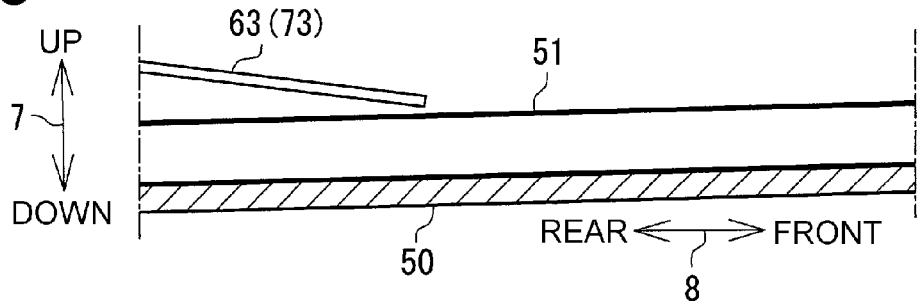
FIG. 12D is an operation explanatory view of the second variation of the illustrative embodiment according to one or more aspects of the disclosure, wherein a cross-sectional view of the platen located in the second position, taken along the line extending along the right-left direction, is illustrated.

When a sheet 6 having relatively greater thickness is conveyed, the platen 50 may be pivoted from the first position depicted in FIG. 12B to a position depicted in FIG. 12C. In one or more examples, the position depicted in FIG. 12C may be between the first position depicted in FIG. 12B and the second position depicted in FIG. 12D. As indicated by the solid line in the FIG. 12A, the sheet 6 may be conveyed while being formed in a corrugated shape in which curves in a corrugated pattern may be more gentle (e.g., have smaller amplitude) than curves in a corrugated pattern formed in plain paper (e.g., indicated by a dashed line in FIG. 12A). The recording portion 45 may eject ink droplets after determining that the corrugated sheet 6 has gentle curves. More specifically, the recording head 46 may eject ink droplets after determining that the distance between the sheet 6 and each of the nozzles 47 (see FIG. 3) may change (e.g., periodically) and an amount of change in the distance may be smaller than an amount of change for plain paper. The inkjet recording apparatus 10 may determine a sheet type, whether the sheet 6 has relatively lower stiffness, relatively higher stiffness, or relatively greater thickness based on information included in a print instruction.

According to the second variation, the platen 50 may be configured to pivot in accordance with one or both of the thickness and stiffness of the sheet 6 being conveyed. Therefore, the inkjet recording apparatus 10 may convey the sheet 6 and record an image onto the sheet 6 regardless of the thickness and the stiffness of the sheet 6.

In the second variation, the rearward part of the platen 50 with respect to the front-rear direction 8 may be movable up and down by the pivoting of the platen 50. Nevertheless, in other embodiments, for example, the platen 50 may be configured such that the entire platen 50 may be movable along the up-down direction 7 while being maintained in a horizontal position.

A third variation of the illustrative embodiment is now described. In the second variation, the platen 50 may be configured to be pivotable such that a sheet 6 having relatively higher stiffness may be conveyed without being formed into a corrugated shape. In the third variation, the contact members 60, 70 may be configured to be pivotable instead of the pivotable platen 50.

Figure 13A:
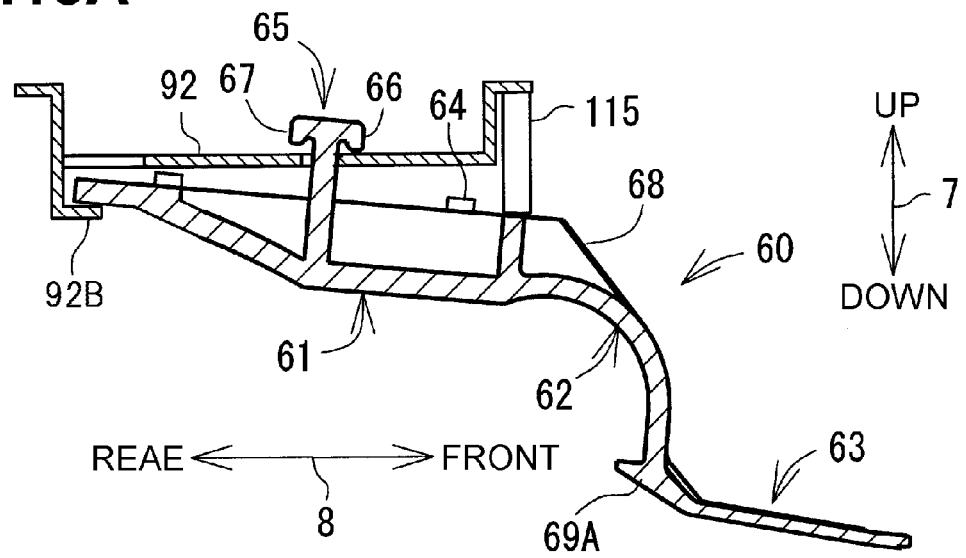
FIG. 13A is an operation explanatory view depicting the one of the contact members, wherein the contact member is located in a third position, in a third variation of the illustrative embodiment according to one or more aspects of the disclosure.
Figure 13B:
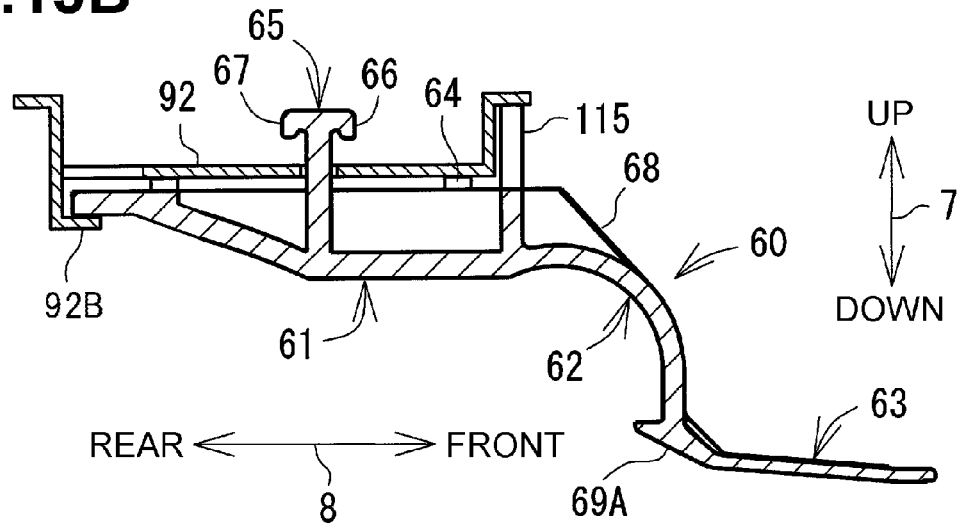
FIG. 13B is an operation explanatory view depicting the one of the contact members, wherein the contact member is located in a fourth position, in the third variation of the illustrative embodiment according to one or more aspects of the disclosure.

As depicted in FIG. 13, the guide rail 92 may comprise receiving portions 92B. The receiving portions 92B may be configured to support rear end portions of the contact members 60, 70, respectively, with respect to the front-rear direction 8. Hereinafter, the configuration of the one of the contact members 60 may be described with reference to FIGS. 13A and 13B. In one or more arrangements, the contact members 70 may have the same configuration as the contact members 60.

According to one or more examples, in contrast to the above-described illustrative embodiment, the contact member 60 might not comprise the rear protrusions 65 with respect to the front-rear direction 8. The front protrusions 65 with respect to the front-rear direction 8 may have a longer length with respect to the up-down direction 7 than the front protrusions 65 (see FIG. 6) of the contact member 60 of the illustrative embodiment. The contact member 60 may be configured to be pivotable between a third position (see FIG. 13A) and a fourth position (see FIG. 13B) about the rear end portion of the contact member 60. When the contact member 60 is in the third position, the pawls 66 of the front protrusions 65 with respect to the front-rear direction 8 may make or be in contact with the upper surface of the guide rail 92. When the contact member 60 is in the fourth position, the stiffening ribs 64 may be in contact with the lower surface of the guide rail 92.

When the contact member 60 is located in the third position, the lower ends of the contact ribs 63A (e.g., the front ends of the contact ribs 63A with respect to the front-rear direction 8) may be located lower than the upper edges of the support ribs 51. When the contact member 60 is located in the fourth position, the lower ends of the contact ribs 63A may be located higher than the upper edges of the support ribs 51. A coil spring 115 (e.g., an urging member) may be disposed between the front end portion of the fixing portion 61 with respect to the front-rear direction 8 and the guide rail 92. The coil spring 115 may be configured to urge the contact member 60 toward the third position (e.g., downward).

When a sheet 6 having relatively higher stiffness (see FIG. 10B) is conveyed, the contact member 60 may be pivoted from the third position to the fourth position by the sheet 6. The sheet 6 may be conveyed without being formed into a corrugated shape while allowing the contact member 60 to stay in the fourth position. The contact member 60 located in the fourth position may be moved back to the third position by an urging force of the coil spring 115 after the sheet 6 passes the contact member 60.

When a sheet 6 having relatively greater thickness is conveyed, the contact member 60 may be pivoted to a position between the third position and the fourth position by the sheet 6. Similar to the case indicated by the solid line in FIG. 12A, the sheet 6 may be conveyed while being formed in a corrugated shape in which curves in a corrugated pattern may be more gentle (e.g., have smaller amplitude) than curves in a corrugated pattern formed in plain paper (indicated by a dashed line in FIG. 12A).

According to the third variation, the contact member 60 may be configured to pivot in accordance with one or both of the thickness and stiffness of the sheet 6. Therefore, the inkjet recording apparatus 10 may convey the sheet 6 and record an image onto the sheet 6 regardless of the thickness and the stiffness of the sheet 6.

In the third variation, the contact members 60, 70 may be configured to be pivotable. Nevertheless, in other embodiments, for example, the contact members 60, 70 may be configured such that the entire bodies of the contact members 60, 70 may be movable along the up-down direction 7.

In the above-described illustrative embodiment, the contact portions 63 may have a plate-like shape. Nevertheless, in other embodiments, for example, the contact portions 63 may have a rod-like shape unless the strength of the contact portions is lowered.

In the above-described illustrative embodiment, a steel plate may be used for the guide rail 92. Nevertheless, in other embodiments, for example, the guide rail 92 may be made of resin material unless the strength of the guide rail 92 is lowered.

In the above-described illustrative embodiment, the contact members 60, 70 are attached to the guide rail 92 via the protrusions 65, 75. Nevertheless, in other embodiments, for example, the contact members 60, 70 may be attached to the guide rail 92 via one or more fasteners, for example, screws. For another example, the guide rail 92 and the contact members 60, 70 may be integrally molded in one piece.

In the above-described illustrative embodiment, two types of the contact members 60, 70 may be used as the contact members. Nevertheless, in other embodiments, for example, either one of the types of the contact members 60 and the contact members 70 may be used as the contact members.

In the above-described illustrative embodiment, each of the contact members 60 may comprise the guide ribs 69A and the contact ribs 63A. Nevertheless, in other embodiments, for example, each of the contact members 60 might not comprise the guide ribs 69A or the contact ribs 63A. In this case, the guide portion 69 may guide the sheet 6 to the contact portion 63 and the lower surface of the contact portion 63 may press the sheet 6. The contact member 70 may have the same configuration.

In the above-described illustrative embodiment, the conveying path 31 may comprise the curved section 32. Nevertheless, in other embodiments, for example, the conveying path 31 may consist of the straight section 33 only.

What is claimed is:

1. An inkjet recording apparatus, comprising:

a conveyor configured to convey a sheet along a conveying direction, the conveyor including a roller configured to contact a first surface of the sheet, and another conveyor part configured to contact a second surface of the sheet opposite to the first surface of the sheet, the roller and the other conveyor part configured to form a nip point therebetween;

a recording portion configured to eject ink droplets from nozzles onto the sheet;

a support member configured to support the recording portion to be movable along a scanning direction, the support member including a first surface and a second surface, the first surface being opposite to the second surface in a direction perpendicular to both the scanning direction and the conveying direction; and a contact member disposed on the support member and comprising a first portion, a second portion and a contact portion configured to contact the first surface of the sheet between the nozzles and the conveyor with respect to the conveying direction, the second portion disposed between the first portion and the contact portion, wherein the recording portion contacts the first surface of the support member, wherein the first portion of the contact member contacts the second surface of the support member when the contact portion is in contact with the sheet, and wherein the second portion of the contact member extends from a first position to a second position downstream of the roller and the other conveyor part of the conveyor in the conveying direction, a part of the second portion disposed at the first position being closer to the support member in the direction perpendicular to both the scanning direction and the conveying direction than a rotational axis of the roller, wherein the second portion does not overlap either the roller or the other conveyor part of the conveyor along any axis parallel to the scanning direction.

2. The inkjet recording apparatus according to claim 1, wherein the support member has an opening having a first size and extending from the first surface to the second surface, and wherein the contact member further comprises:

a protruding portion having substantially the same size as the opening having the first size, wherein the protruding portion is configured to engage with the opening; and an engaging portion disposed on the protruding portion and having a size that is larger than the opening having the first size, wherein the engaging portion is configured to engage with the support member.

3. The inkjet recording apparatus according to claim 2, wherein the protruding portion and the engaging portion form an attaching portion, wherein the contact member further comprises a plurality of attaching portions, wherein the support member has a plurality of openings of the first size, and wherein the engaging portion is configured to engage with the support member in the direction perpendicular to both the scanning direction and the conveying direction.

4. The inkjet recording apparatus according to claim 3, wherein the contact member further comprises a projection, and wherein the support member comprises a locating portion configured to receive the projection.

5. The inkjet recording apparatus according to claim 4, wherein the plurality of attaching portions are arranged on the contact member along the scanning direction, wherein the projection is disposed between the plurality of attaching portions with respect to the scanning direction, and wherein the plurality of openings are arranged on the support member along the scanning direction, wherein the locating portion is disposed between the plurality of openings with respect to the scanning direction.

6. The inkjet recording apparatus according to claim 2, wherein the support member further comprises:

an opening having a second size larger than the engaging portion, wherein the opening having the first size extends to the opening having the second size.

7. The inkjet recording apparatus according to claim 6, wherein the opening of the first size extends from the opening of the second size in the scanning direction.

8. The inkjet recording apparatus according to claim 1, further comprising a platen configured to support the sheet, wherein the first portion of the contact member is disposed upstream of the conveyor with respect to the conveying direction, and wherein the second portion of the contact member further comprises:

an arm having one end supporting the contact portion; and a guide portion supported by the one end of the arm, wherein the guide portion is inclined toward the platen and extends toward the conveyor in a direction opposite to the conveying direction, and wherein the guide portion is configured to guide the sheet conveyed by the conveyor to the contact portion.

9. The inkjet recording apparatus according to claim 8, wherein an upstream end of the guide portion with respect to the conveying direction is located upstream of a downstream end of the conveyor with respect to the conveying direction.

10. The inkjet recording apparatus according to claim 2, wherein first portion of the contact member further comprises a restricting portion configured to come into contact with the second surface of the support member, and wherein the contact member is configured to move between a first pressing position and a second pressing position with respect to a pressing direction in which the contact portion presses the sheet, and wherein the engaging portion contacts the first surface of the support member and the restricting portion is not in contact with the second surface when the contact member is located in the first pressing position, and wherein the restricting portion contacts the second surface of the support member when the contact member is located in the second pressing position.

11. The inkjet recording apparatus according to claim 1, wherein a plurality of contact members are disposed on the support member and wherein the plurality of contact members are spaced apart from each other with respect to the scanning direction.

12. The inkjet recording apparatus according to claim 1, further comprising a platen, wherein the platen comprises a plurality of support ribs that protrude toward the recording portion, and wherein the contact portion is disposed between a pair of support ribs of the plurality of support ribs with respect to the scanning direction, and wherein a protruding edge of the pair of support ribs is located closer to the recording portion than an end of the contact portion, wherein the end of the contact portion is configured to come into contact with the sheet.

13. The inkjet recording apparatus according to claim 12, further comprising a plurality of contact portions, wherein each of the plurality of contact portions is disposed between a respective pair of support ribs of the plurality of support ribs.

14. The inkjet recording apparatus according to claim 12, wherein the contact portion overlaps the pair of support ribs with respect to the conveying direction.

15. The inkjet recording apparatus according to claim 12, wherein the platen is configured to move between a first platen position and a second platen position, wherein a gap between the platen and the recording portion when the platen is located in the second platen position is greater than a gap between the platen and the recording portion when the platen is located in the first platen position, and wherein the inkjet recording apparatus further comprises an urging member configured to urge the platen toward the recording portion.

16. The inkjet recording apparatus according to claim 1, further comprising a platen movable between a first platen position and a second platen position, wherein the platen comprises a plurality of support ribs that protrude toward the recording portion, wherein the contact portion is disposed between a pair of support ribs of the plurality of support ribs with respect to the scanning direction, wherein when the platen is located in the first platen position, a protruding edge of the support rib is located closer to the recording portion than an end of the contact portion, and when the platen is located in the second platen position, the end of contact portion is located closer to the recording portion than the protruding edge of the support rib.

17. The inkjet recording apparatus according to claim 12, wherein the contact member is configured to move between a first contact position and a second contact position, wherein a gap between the contact portion and the platen when the contact member is located in the second contact position is greater than a gap between the contact portion and the platen when the contact member is located in the first contact position, and wherein the inkjet recording apparatus further comprises an urging member configured to urge the contact member toward the platen.

18. The inkjet recording apparatus according to claim 1, further comprising a platen comprising a plurality of support ribs that protrude toward the recording portion, wherein the contact portion is disposed between a pair of support ribs of the plurality of support ribs with respect to the scanning direction, wherein the contact member is movable between a first contact position and a second contact position, wherein when the contact member is located in the first contact position, an end of the contact portion is located closer to the platen than a protruding edge of the support rib, and when the contact member is located in the second contact position, the end of the contact portion is located closer to the recording portion than the protruding edge of the supporting rib.

19. The inkjet recording apparatus according to claim 1, wherein the contact portion is composed of elastic material.

20. The inkjet recording apparatus according to claim 1, further comprising a platen configured to support the sheet, wherein the contact portion is inclined such that a downstream end of the contact portion is located closer to the platen than an upstream end of the contact portion with respect to the conveying direction.

21. The inkjet recording apparatus according to claim 1, wherein a thickness of the contact portion decreases toward a downstream end with respect to the conveying direction and wherein a width of the contact portion, in the scanning direction, decreases toward the downstream end with respect to the conveying direction.

22. The inkjet recording apparatus according to claim 1, further comprising a platen configured to support the sheet, wherein the contact portion comprises a contact rib that protrudes toward the platen and extends along the conveying direction.

23. An inkjet recording apparatus comprising:

a conveyor configured to convey a sheet along a conveying direction, the conveyor including a roller configured to contact a first surface of the sheet, and another conveyor part configured to contact a second surface of the sheet opposite to the first surface of the sheet, the roller and the other conveyor part configured to form a nip point therebetween;

a platen disposed downstream of the conveyor with respect to the conveying direction and comprising a plurality of ribs;

a carriage disposed opposite to the platen and comprising a recording head configured to eject ink droplets from nozzles along a scanning direction;

a carriage frame configured to movably support the carriage, the carriage frame including a first surface and a second surface, the first surface being opposite to the second surface in a direction perpendicular to both the scanning direction and the conveying direction; and a contact member comprising a first portion, a second portion and a contact portion configured to contact the sheet at a position between the conveyor and the nozzles with respect to the conveying direction, and wherein the contact portion is disposed between a pair of ribs of the plurality of ribs with respect to a moving direction of the carriage, the second portion disposed between the first portion and the contact portion, wherein, when the platen is not supporting the sheet, a protruding edge of a support rib, of the plurality of ribs, is located closer to the carriage than an edge of the contact portion in a pressing direction in which the contact portion is configured to contact the sheet, wherein the carriage contacts the first surface of the carriage frame, wherein the contact member contacts the second surface of the carriage frame when the contact portion is in contact with the sheet, and wherein the second portion of the contact member extends from a first position to a second position downstream of the roller and the other conveyor part of the conveyor in the conveying direction, a part of the second portion disposed at the first position being closer to the carriage frame in the direction perpendicular to both the scanning direction and the conveying direction than a rotational axis of the roller, wherein the second portion does not overlap either the roller or the other conveyor part of the conveyor along any axis parallel to the scanning direction.

24. The inkjet recording apparatus of claim 1, further comprising a plurality of physically distinct contact members, wherein each of the plurality of physically distinct contact members is separately attached to the support member.

25. The inkjet recording apparatus of claim 1, wherein the contact member is movably disposed on the support member, and wherein the contact member is movable relative to the support member in the direction perpendicular to both the scanning direction and the conveying direction.

* * * * *